US009394722B2

(12) United States Patent
Moon et al.

(10) Patent No.: US 9,394,722 B2
(45) Date of Patent: Jul. 19, 2016

(54) ATTACK-THWARTING CYLINDRICAL LOCKSET

(71) Applicant: Townsteel, Inc., City of Industry, CA (US)

(72) Inventors: Charles W. Moon, Colorado Springs, CO (US); Michael J. Wright, Santa Ana, CA (US)

(73) Assignee: TOWNSTEEL, INC., City of Industry, CA (US)

( * ) Notice: Subject to any disclaimer, the term of this patent is extended or adjusted under 35 U.S.C. 154(b) by 380 days.

(21) Appl. No.: 13/742,128

(22) Filed: Jan. 15, 2013

(65) Prior Publication Data

US 2014/0196509 A1 Jul. 17, 2014

(51) Int. Cl.

| | |
|---|---|
| ***E05B 55/04*** | (2006.01) |
| ***E05B 17/20*** | (2006.01) |
| ***E05B 55/00*** | (2006.01) |
| *E05B 63/16* | (2006.01) |

(52) U.S. Cl.

CPC ..... *E05B 17/2092* (2013.01); *E05B 55/005* (2013.01); *E05B 63/16* (2013.01); *Y10T 70/20* (2015.04)

(58) Field of Classification Search

USPC ..... 70/101, 149, 221–224, 448, 449, 472; 292/163, 169, 347

See application file for complete search history.

(56) References Cited

U.S. PATENT DOCUMENTS

| | | | | |
|---|---|---|---|---|
| 2,018,093 | A | | 10/1935 | Schlage |
| 2,098,868 | A | | 11/1937 | Grimmond |
| 2,660,466 | A | | 11/1953 | Cerf, Jr. |
| 2,676,050 | A | | 4/1954 | Nichols |
| 2,778,667 | A | | 1/1957 | Yong |
| 3,116,080 | A | * | 12/1963 | Williams ..... 292/1 |
| 3,128,115 | A | | 4/1964 | Patriquin et al. |
| 3,196,644 | A | | 7/1965 | Russell et al. |
| 3,233,439 | A | * | 2/1966 | Papas ..... E05B 55/005 292/153 |
| 3,337,254 | A | | 8/1967 | Russell et al. |
| 3,621,685 | A | | 11/1971 | Sargent |
| 3,779,590 | A | | 12/1973 | Sanders et al. |
| 4,342,478 | A | | 8/1982 | Foshee |

(Continued)

FOREIGN PATENT DOCUMENTS

| | | | |
|---|---|---|---|
| CN | 101128640 | A | 2/2008 |
| CN | 101280644 | A | 10/2008 |

(Continued)

OTHER PUBLICATIONS

Builders Hardware Manufacturers Association, American National Standard for Bored and Preassembled Locks and Latches, ANSI/BHMA A152.2-2003.

*Primary Examiner* — Christopher Boswell
(74) *Attorney, Agent, or Firm* — Eric W. Cernyar

(57) ABSTRACT

Mechanisms are provided to thwart an overtorquing attack on a cylindrical lockset. The cylindrical lockset comprises a lock cage, a split retractor assembly, and a torque-attack-activated spring-loaded blocker assembly coupled to the lock cage. The blocker assembly is set to a default non-blocking configuration. An overtorquing attack triggers the blocking assembly into a blocking setting. When in the blocking setting, the blocking assembly blocks movement of at least an outside door portion of a retractor assembly from translating into a latch-retracting position, but does not block the inside door handle from retracting the latch. A new split retractor assembly is also provided.

17 Claims, 19 Drawing Sheets

(56) References Cited

U.S. PATENT DOCUMENTS 4,394,821 A 7/1983 Best et al.
4,424,691 A 1/1984 Foshee
4,428,212 A 1/1984 Best et al.
4,428,570 A 1/1984 Foshee et al.
4,437,695 A 3/1984 Foshee
4,604,879 A * 8/1986 Neary et al. ..... 70/224
4,974,883 A * 12/1990 Jans ..... E05B 9/002 292/169
5,125,696 A 6/1992 Robida et al.
5,141,269 A 8/1992 Haq et al.
5,269,162 A 12/1993 Robida et al.
5,335,948 A 8/1994 Norton, II et al.
5,385,374 A * 1/1995 Fann et al. ..... 70/224
5,421,178 A 6/1995 Hamel et al.
5,441,318 A 8/1995 Ghostley
5,564,296 A * 10/1996 Theriault et al. ..... 70/224
5,617,749 A 4/1997 Park
5,694,798 A 12/1997 Nunez et al.
5,761,936 A 6/1998 Katayama
5,794,472 A 8/1998 Kester et al.
5,845,522 A * 12/1998 Shen ..... 70/224
5,931,430 A 8/1999 Palmer
5,947,537 A 9/1999 Aigner et al.
5,983,687 A 11/1999 Shen
6,030,008 A * 2/2000 Chang ..... E05B 63/06 292/169
6,038,896 A 3/2000 Chamberlain et al.
6,048,007 A 4/2000 Shor
6,101,856 A 8/2000 Pelletier et al.
6,151,934 A * 11/2000 Chong et al. ..... 70/221
6,189,351 B1 2/2001 Eagan et al.
6,279,360 B1 8/2001 Shen
6,412,318 B1 7/2002 Shen
6,626,018 B2 9/2003 Eller et al.
6,735,993 B2 5/2004 Eller et al.
6,736,432 B2 * 5/2004 Huang ..... E05B 55/005 292/163
6,935,148 B2 * 8/2005 Don ..... 70/472
6,979,029 B2 * 12/2005 Shen ..... 70/224
7,703,815 B2 * 4/2010 Berkseth ..... E05B 53/00 292/164
7,748,758 B2 * 7/2010 Fang et al. ..... 70/224
8,182,005 B2 * 5/2012 Liu et al. ..... 70/224
8,256,253 B2 9/2012 Chen et al.
8,449,005 B1 5/2013 Wang
8,844,330 B2 9/2014 Moon et al.
2004/0074269 A1 4/2004 Lee
2005/0218665 A1 10/2005 Shen
2006/0042333 A1 3/2006 Wu
2007/0096479 A1 5/2007 Lin et al.
2008/0168809 A1 7/2008 Liu et al.
2008/0216529 A1 9/2008 Kim et al.
2009/0152875 A1 6/2009 Gray et al.
2009/0288459 A1 * 11/2009 Liu et al. ..... 70/224
2010/0307207 A1 12/2010 Vogel et al.
2011/0006550 A1 1/2011 Cho
2012/0017657 A1 1/2012 Chen et al.
2013/0229021 A1 9/2013 Wang
2013/0234453 A1 9/2013 Murphy et al.
2014/0196509 A1 7/2014 Moon et al.

FOREIGN PATENT DOCUMENTS

JP 2007277973 A 10/2007
KR 1020050047100 2/2005
KR 1020070020205 2/2007
KR 100897489 B1 5/2009
TW M411457 9/2001
TW M255299 1/2005
TW M294541 U 7/2006
TW M338886 8/2008
TW M350588 2/2009

* cited by examiner

Fig. 45
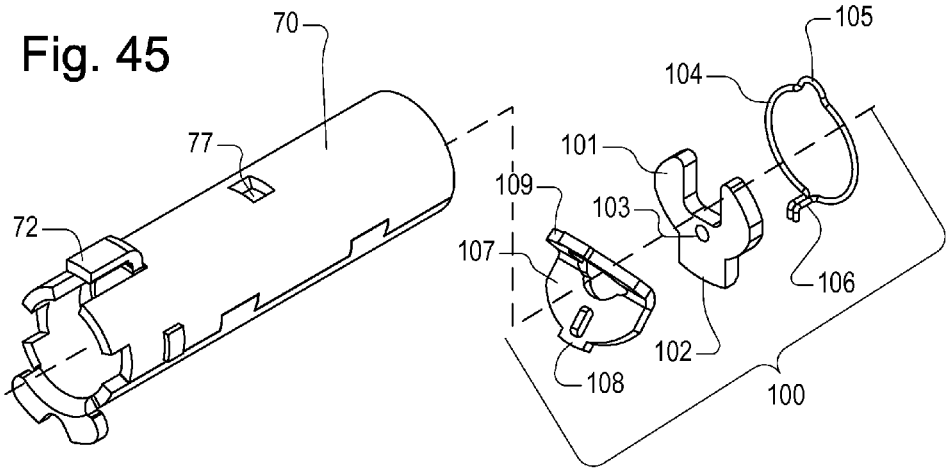
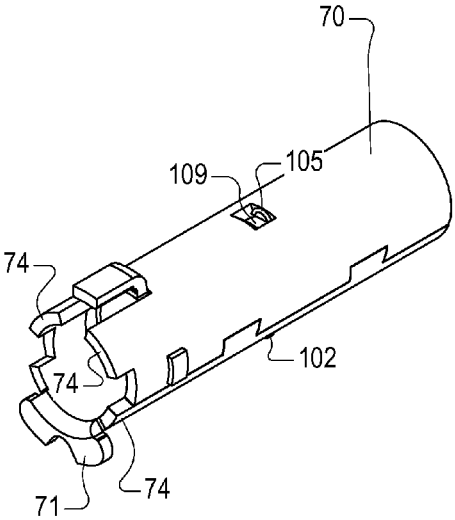
Fig. 46
Fig. 47
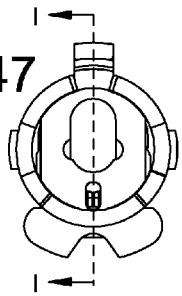
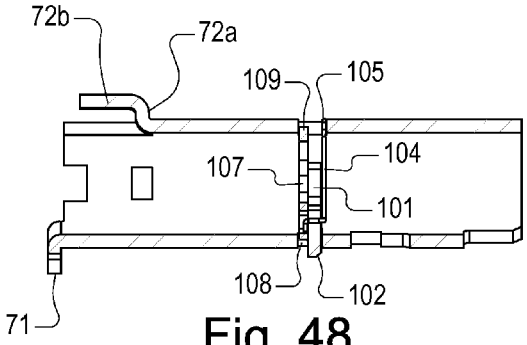
Fig. 48

ATTACK-THWARTING CYLINDRICAL LOCKSET

FIELD OF THE INVENTION

This invention relates generally to door latching assemblies, and more specifically, to cylindrical locksets.

BACKGROUND

This application builds upon the specifications filed in U.S. application Ser. Nos. 13/420,526 and 13/420,532, both filed Mar. 14, 2012, both of which are herein incorporated by reference.

A number of techniques have been developed to attack a lock. One method of attack is to overtorque a handle using, for example, a long wrench. Overtorquing a handle causes internal components to break. Depending on the design of the lock, this can enable an intruder to open the door. Another method is to strike the lever arm in one direction, and then jerk it back in another, rapidly enough or repeatedly enough to work the door components free.

To disable such methods of attack, U.S. Pat. No. 5,794,472 to Best discloses a locking lug with a shear line or frangible section that shears if the outside door handle is overtorqued. Shearing off the locking lug does not, however, prevent key cylinder rotation. Best requires an outside door handle that is configured to engage the door frame, and prevent further rotation, after the outside door handle has been rotated to about 93°. Accordingly, this solution would not work on typical out swinging doors, which are common in many public buildings, like classrooms, in order to meet fire code egress requirements. Best also requires a thick cast steel outer hub to house the locking lug, key cylinder, and an associated lost motion drive member.

The present invention described below can be characterized in many different ways, not all of which are limited by its capacity to address the above-mentioned issues, needs or design constraints.

SUMMARY

A cylindrical lockset is provided that is designed to thwart an overtorquing attack. The cylindrical lockset comprises a latch, a lock cage, a retractor assembly, and a torque-attack-activated blocker assembly coupled to the lock cage. The blocker assembly is set to a default non-blocking configuration and is operative to be activated by an overtorquing attack into a blocking setting. When in the blocking setting, the blocker assembly blocks movement of at least an outside door portion of a retractor assembly from translating into a latch-retracting position, but does not block the inside door handle from retracting the latch.

In one embodiment, the blocker assembly comprises a pair of stopping tabs, and the outer cam-activated retractor comprises a pair of stop elbows. When the blocker assembly is in a blocking setting, the stopping tabs interfere with the stop elbows to block the outer cam-activated retractor from moving into a latch-retracting position. The blocker assembly is spring-loaded to snap from its non-blocking setting to its blocking setting when the outside door handle is subjected to an overtorquing attack.

Characterized another way, a spring-loaded trap is coupled to the lock cage. The trap is operable to be activated by an overtorquing attack to prevent the outer spindle from causing the retractor assembly to retract the latch. The spring-loaded trap is triggered by rotation of the outer spindle bearing relative to the lock cage. The trap, when activated, disables the outer cam-activated retractor.

Preferably, the retractor assembly comprises an inner cam-activated retractor and an outer cam-activated retractor. The outer cam-activated retractor is configured, when activated and not blocked by the blocker assembly, to press the inner cam-activated refractor to retract the latch.

Also in one embodiment, a holder assembly is positioned on an inside of the lock cage. The holder assembly holds the blocker assembly in the non-blocking setting as long as the outside door handle is not subjected to an overtorquing attack. An overtorquing attack causes rotation of the holder assembly, causing the blocker assembly to move into the blocking setting. In one particular embodiment, the holder assembly comprises posts situated on a cage retaining flange of a spindle bearing staked to the lock cage, the posts holding corresponding trigger tabs of the blocker assembly in the non-blocking setting.

Characterized another way, a spindle bearing is staked to the lock cage and maintains the blocker assembly in the non-blocking setting as long as the outside door handle is not subjected to an overtorquing attack. The spindle bearing is configured to rotate, relative to the lock cage, when the outside door handle is subjected to an overtorquing attack.

These and other aspects and advantages of the embodiments disclosed herein will become apparent in connection with the drawings and detailed disclosure that follows.

BRIEF DESCRIPTION OF THE DRAWINGS

FIG. 45 is an exploded view of an embodiment of a knob catch assembly configured for the inside handle-carrying spindle.

FIG. 46 is a perspective view of the inside handle-carrying spindle with the knob catch assembly assembled within.

FIG. 47 is an end plan view of the spindle and knob catch assembly of FIG. 46.

FIG. 48 is a partial cross-sectional view of an embodiment of the spindle and knob catch assembly taken along line I-I of FIG. 47.

DETAILED DESCRIPTION

Figure 1:
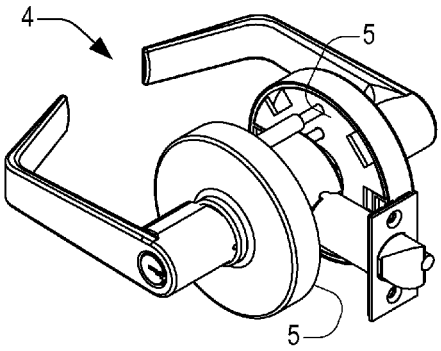
Fig. 1 PRIOR ART
FIG. 1 is a perspective view of a conventional prior-art cylindrical lockset, including internal rose cages that house the lever return springs.

FIGS. 5-41 and 43-51 illustrate various embodiments and aspects of a multi-lock-function-supporting cylindrical lock assembly (or lockset) 10. The cylindrical lock assembly 10 is preferably made of steel and, despite its light weight and extensive use of sheet metal parts, complies with ANSI/BHMA A156.2-2003 requirements (the specification of which is incorporated by reference) for a Grade 1 lock. The cylindrical lock assembly 10 comprises a lock chassis assembly 18, torque plate 110, key spindle assembly 140, inside handle button stem subassembly 200, key cylinder 215, cylindrical handle-carrying spindles 70 and 80, a latch bolt assembly 280, and trim pieces 220, 230, 240, and 245. The cylindrical lock assembly 10 depicted herein accommodates a range of standard door widths, such as between 1¾" and 2" thick doors.

Figure 5:
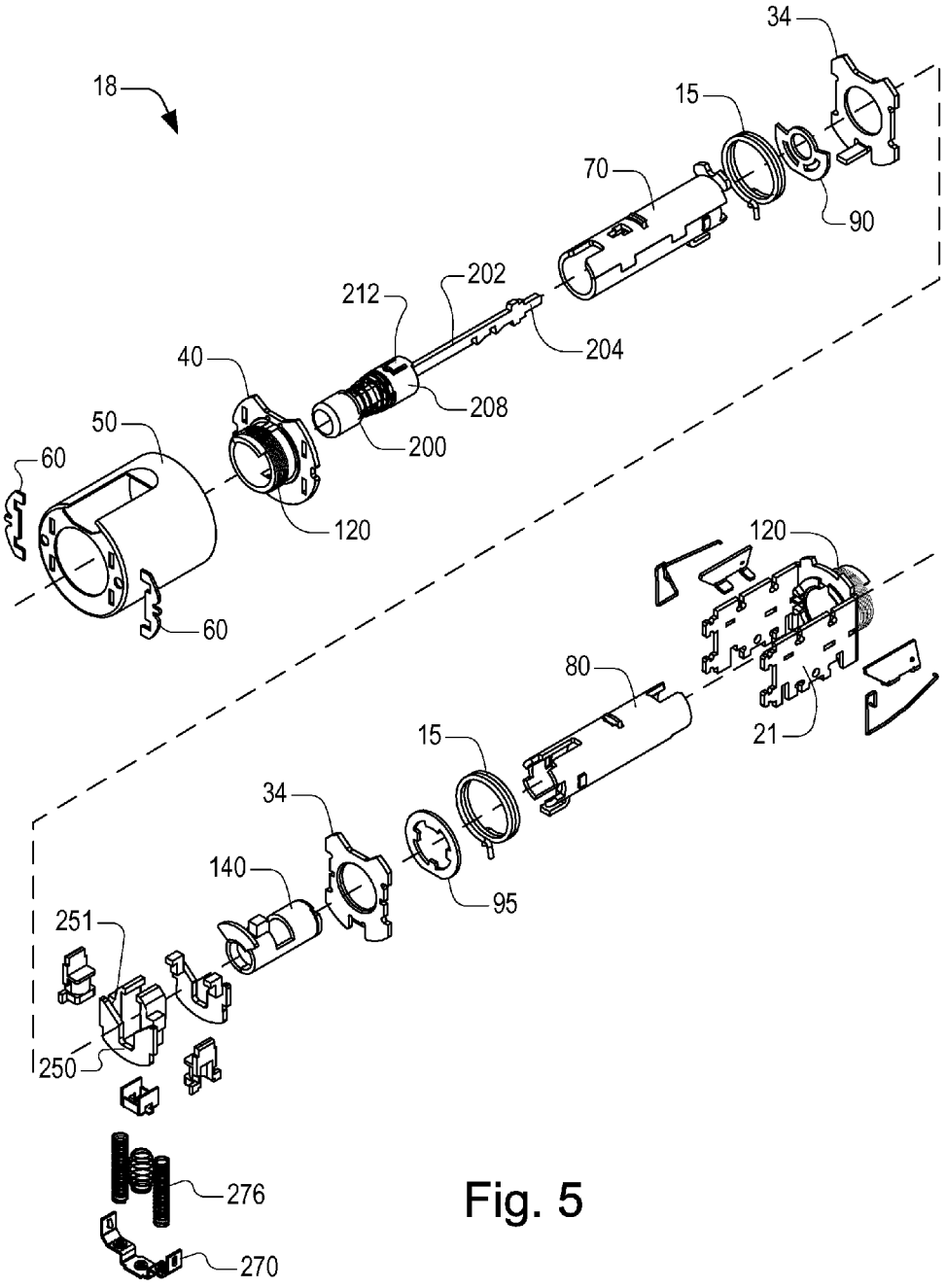
FIG. 5 is an exploded perspective view of one embodiment of a lock chassis assembly.
Figure 24:
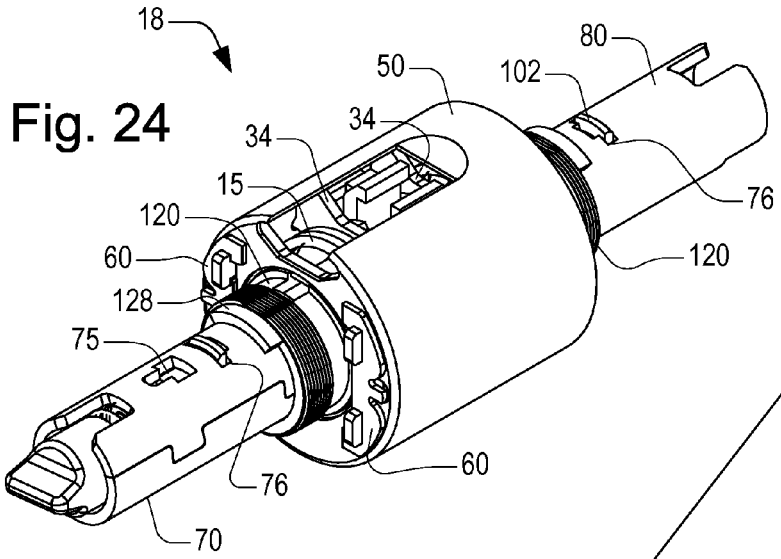
FIG. 24 is a perspective view of the lock chassis assembly.
Figure 25:
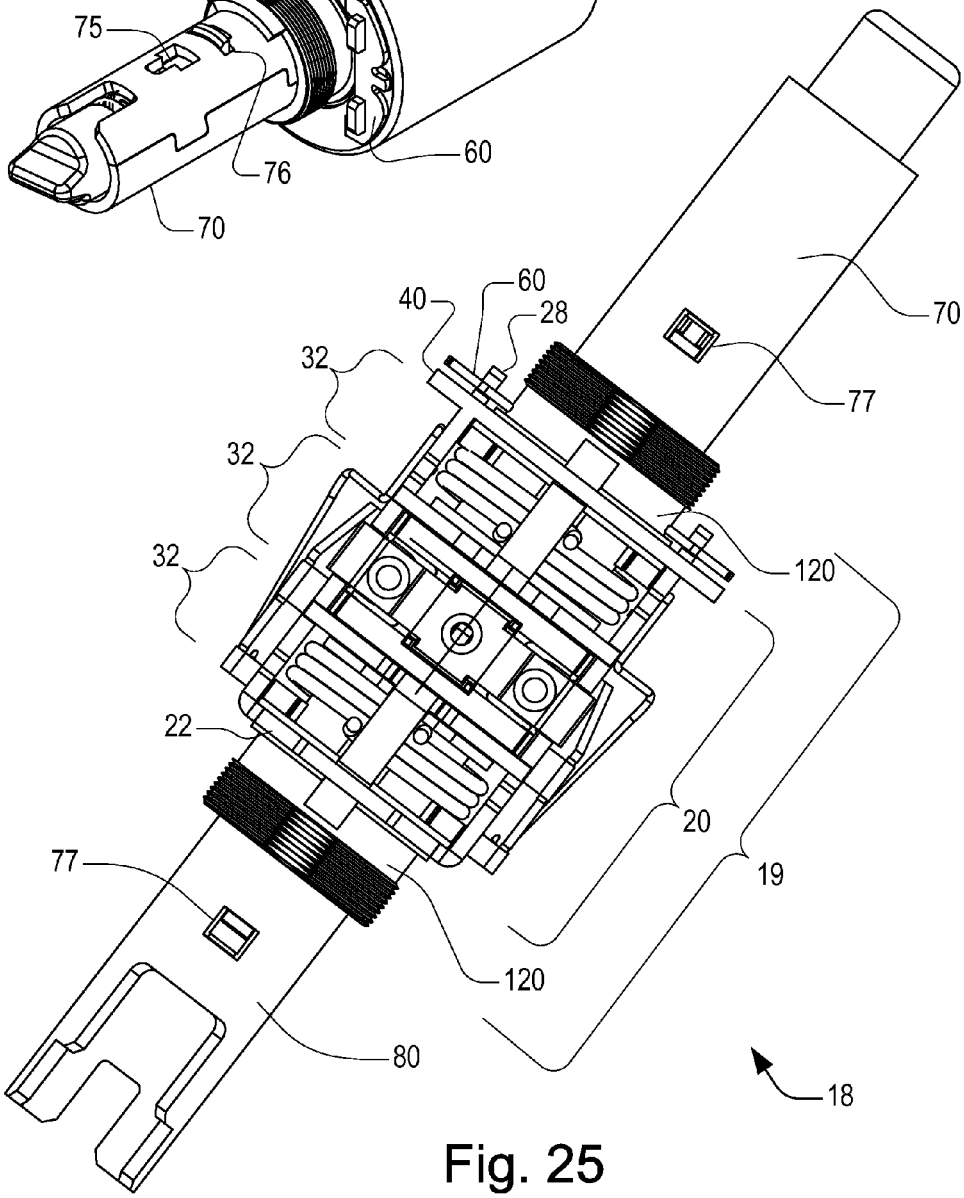
FIG. 25 is a top, cut-away view of the lock chassis assembly.

Attention is first directed to the lock chassis assembly 18. FIG. 5 is a perspective exploded view of one embodiment of a lock chassis assembly 18, and FIG. 24 provides a perspective view of the lock chassis assembly 18 in assembled form. As best illustrated in FIGS. 24 and 25, the lock chassis assembly 18 comprises the lock body 19, cover 50, and tubular handle-carrying spindles 70 and 80. The lock body 19 comprises the multi-compartment lock cage subassembly 20 and spindle bearings 120.

Figure 19:
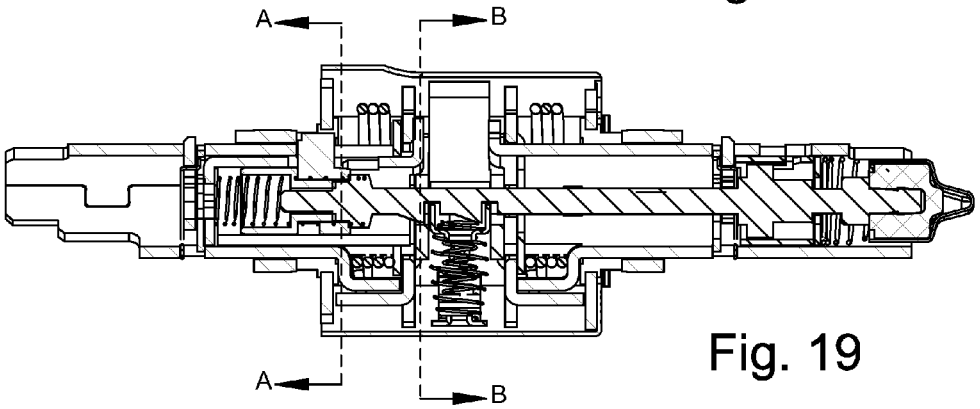
FIG. 19 is a cross-sectional view of the lock chassis assembly.

FIGS. 6-12 illustrate the components of the multi-compartment lock cage subassembly 20 (alternatively referred to as a chassis), which houses both the refractor assembly 250 and two torsion-type spindle return springs 15 (alternatively referred to as lever return springs) within axially adjacent compartments 32 (FIG. 19). The lock cage subassembly 20 comprises a main piece 21, an end plate 40, and separator plates 34, all formed out of stamped sheet metal (preferably steel).

As shown in FIGS. 6-11, spindle bearings 120—preferably machined and not cast—are securely mounted to each of the main piece 21 and end plate 40 (through corresponding spindle bearing apertures) prior to assembly of the lock cage subassembly 20. Notches 134 line the spindle bearing 120 up with and index into corresponding stakes or tabs 33 or 43 of the lock cage main piece base portion 22 or end plate 40, respectively. A ring-shaped cage retaining flange 126 butts the spindle bearing 120 against the corresponding lock cage main piece base portion 22 or end plate 40. Each spindle bearing 120 is also securely ring staked, opposite the lock cage retaining flange 126, to the corresponding lock cage main piece base portion 22 or end plate 40.

Figure 20:
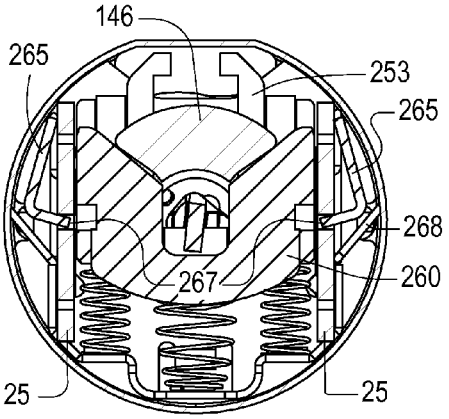
FIGS. 20 and 21 show the outer cam-activated retractor under normal and overtorque-attack-activated conditions, respectively, using partial cross-sectional views taken along line A-A of FIG. 19.
Figure 21:
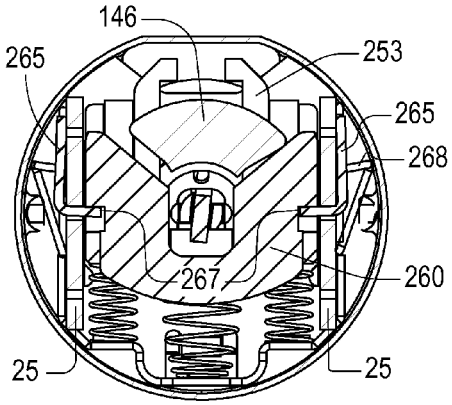
Figure 27:
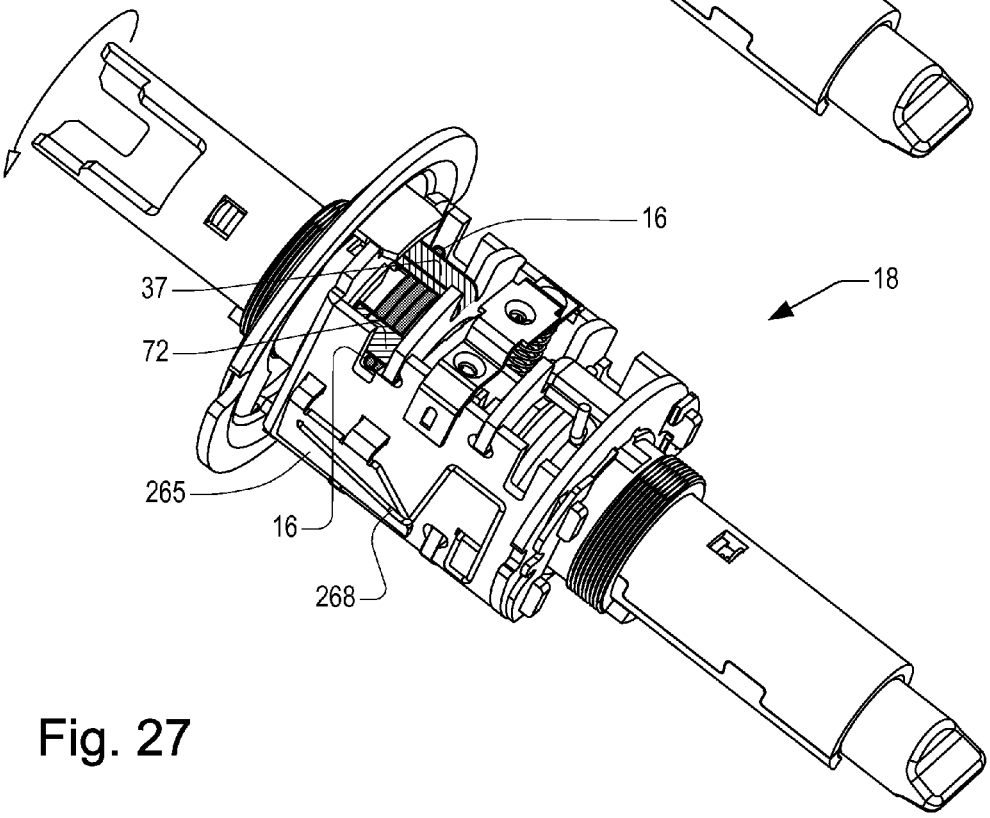
FIG. 27 is a perspective cut-away view of the same lock chassis assembly of FIG. 26, illustrating the outer handle-carrying spindle rotated to a maximum clockwise position, winding up the torsion lever return spring.

The main piece 21 comprises a base portion 22 and two axially-extending edge flanges 25. Separator plate notches 26 formed in the edge flanges 25 retain the separator plates 34 (FIG. 12), as illustrated in FIGS. 20 and 21. Torsion spring leg notches 27 formed in the edge flanges 25 provide room for legs 16 of spindle return springs 15 to travel through full configured limits of spindle rotation, as illustrated in FIG. 27. Slots 301 and 302 receive tabs 266 and 267 of blockers 265 that function to thwart an overtorquing attack.

The separator plates 34 (FIG. 12) divide the lock cage subassembly 20 into three compartments 32 (FIG. 25), a middle compartment for the split refractor 250 and two axially adjacent compartments for the spindle return springs 15. Engagement flanges 35 (alternatively referred to as corner toes) seat the separator plates 34 in corresponding lock cage notches 25. Centrally located spindle apertures 36 allow handle-carrying spindles 70 and/or 80 to pass through. Radiused edges 38 enable the separator plates 34 to fit securely within in the cylindrical sheet metal cover 50.

Each spindle 70 and 80 is mounted for rotation in the cylindrical sleeve 122 of the corresponding spindle bearing 120. As illustrated in FIGS. 45 and 47, each spindle 70 and 80 is formed of rolled-up stamped sheet metal (preferably steel). The inner spindle 70 includes bent up, ear-like retractor activation cams 71 (referred to by some in the art as roll-back cams) that are configured to engage and operate on corresponding retractor slide cam surfaces 251 (FIG. 5) when a user turns the inside door handle 12.

As discussed in more detail below, each spindle 70 and 80 provides a knob catch lug cross slot 76 (FIGS. 24, 50 and 51) and a knob catch spring seat 77 (FIGS. 45 and 49) positioned opposite the knob catch cross slot 76. The knob catch lug cross slot 76 provides an aperture for the depressible knob catch projecting lug 102. The knob catch spring seat 77 provides an aperture or depression for seating the knob catch spring 104.

The inside spindle 70 also provides an inside lever button subassembly collar retention slot 75 (FIG. 24) for retaining the resilient tab 212 of a collar 208 of the inside handle button subassembly 200. The outside spindle 80 provides an axially extending key spindle dog driving slot 81 (FIG. 49) that interfaces with the key spindle dog arm 162 of a key spindle assembly 140 and allows for axial movement of the dog arm 162 within the slot 81.

It will be understood that some cylindrical lock configurations may use two inner spindles 70, for example, for a non-locking passage. Others may use two outer spindles 80, for example, where both are locking.

Figure 8:
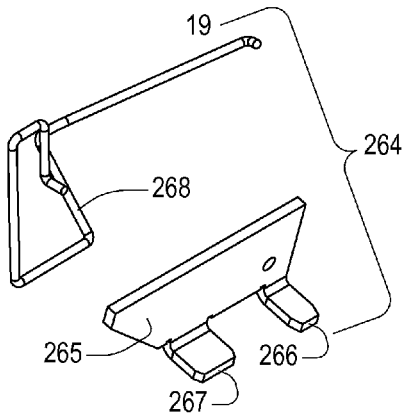
FIG. 8 is a perspective view of the blocker assembly.

The lock body end of the inner spindle 70 extends all the way through the spindle aperture 36 of one of the separator plates 34, with its retractor activation cams 71 in the middle compartment 32 ready to act on the inner cam-activated retractor 251 (FIG. 8). The lock body end of the outer spindle 80, which houses a key cylinder assembly 140, extends just into the spindle aperture 36 of the opposite separator plate 34.

Figure 13:
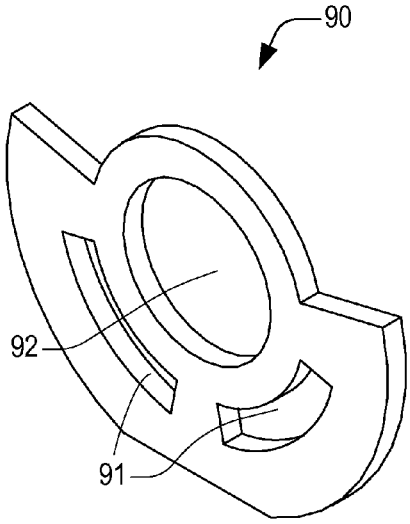
FIG. 13 is a perspective view of the inner spindle handle-carrying thrust plate.
Figure 14:
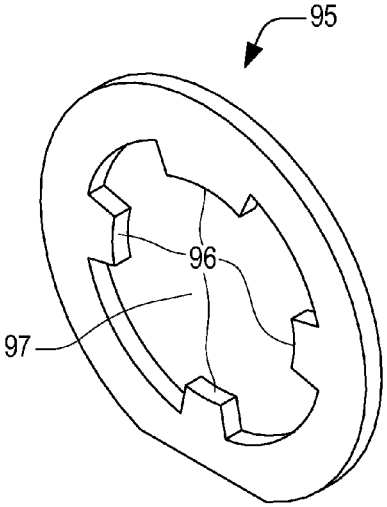
FIG. 14 is a perspective view of the outer spindle handle-carrying thrust plate.
Figure 15:
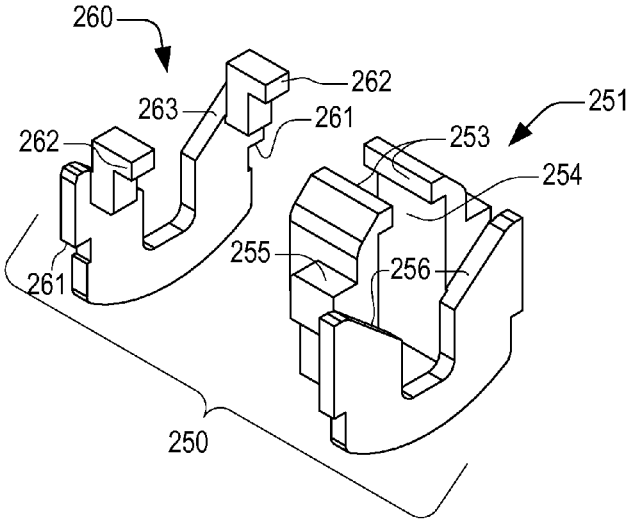
FIG. 15 is a perspective view of the retractor assembly.
Figure 16:
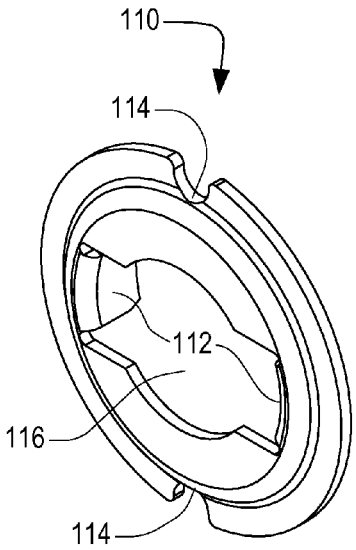
FIG. 16 is a perspective view of the torque plate.

As illustrated in FIGS. 13 and 14, thrust washers (or thrust plates) 90 and 95 provide a wide area bearing surface to distribute axial and rotational loads of the corresponding spindle 70 or 80 against its corresponding separator plate 34. The arcuate slots 91 seat the thrust washer 90 over corresponding crenellations 74 (FIG. 46) of the inner spindle 70. Arcuate centrally projecting tabs 96 of the thrust washer 95 enable it to seat between corresponding crenellations 84 (FIG. 49) of the outer spindle 80. Each thrust washer 90 and 95 includes a respective spindle aperture 92 or 97 to permit passagethrough of a respective push button stem 202 (FIGS. 5, 35) or key spindle assembly 140.

Figure 26:
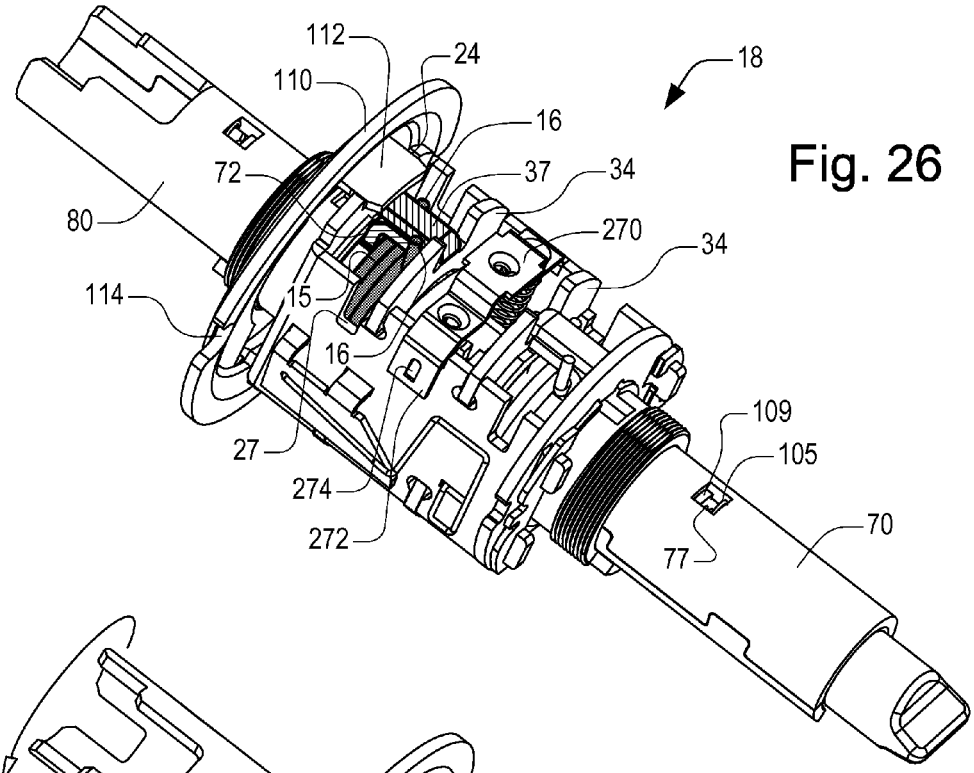
FIG. 26 is a perspective cut-away view of the lock chassis assembly with a torque plate, illustrating a torsion lever return spring biasing the outer handle-carrying spindle to the neutral, non-latch-retracting position.

Each spindle 70 and 80 includes a curved distal tab 72 (alternatively referred to as bent-up spring tab) that includes radial and axial extending portions 72*a* and 72*b* (FIG. 48), respectively. The curved distal tab 72 is sized for rotational movement within the corresponding spindle return spring compartment 32, and serves to wind up a corresponding spindle return spring 15. Serving a complementary function, each separator plate 34 includes a bent spring retaining tab (or torsion spring leg stop) 37. As shown in FIG. 26, tab 72 is, in a neutral position, positioned just under the torsion leg stop 37 of the separator plate 34. As shown in FIG. 27, the spring legs 16 of the corresponding spindle return spring 15 are mounted, in tension, on either side of tabs 72 and 37. As comparatively illustrated in FIGS. 26 and 27, the axially extending portion 72*b* of the tab 72 bears against one or the other of the spring legs 16—depending on the direction of rotation—of the spindle return spring 15 while the spring retaining tab 37 of the separator plate 34 holds the opposite spring leg 16 in place, winding up the spindle return spring 15 as the spindle 70 or 80 turns.

Focusing again on the lock cage subassembly 20, retractor biasing spring retainer notches 30 and holes 31 formed in the edge flanges 25 (FIG. 6) receive mounting tabs 272 and catch projections 274, respectively, a spring retainer 270 (FIGS. 5, 26). The spring retainer 270 seats latch springs 276 (FIGS. 5, 34) to urge the split retractor 250 into a latch-extending position.

The edge flanges 25 are originally bent (in the die) at right angles with the base portion 22. During assembly, the edge flanges 25 are opened slightly to receive and enable assembly of the internal components of the lock body 19, including the separator plates 34, torsion spindle return springs 15, thrust plates 90 and 95, the key cylinder assembly 140, and the split retractor 250. Also during assembly, the edge flanges 25 are bent back to right angles with the base portion 22, and the end plate 40 mounted to the edge flanges 25 through lugs 28.

The configuration of the lugs 28 (FIG. 7) and the corresponding slots 41 (FIG. 9) of the end plate 40 allow the end plate 40 to be directly axially inserted on and mounted to the main piece 21, without axial offset. After mounting the end plate 40 to the main piece 21, the cover 50 is placed over, in sleeve-like fashion, over the lock body 19, causing lugs 28, which already project through the aligned end plate slots 41 (FIG. 9), to further project through cover slots 53 (FIG. 18).

Figure 2:
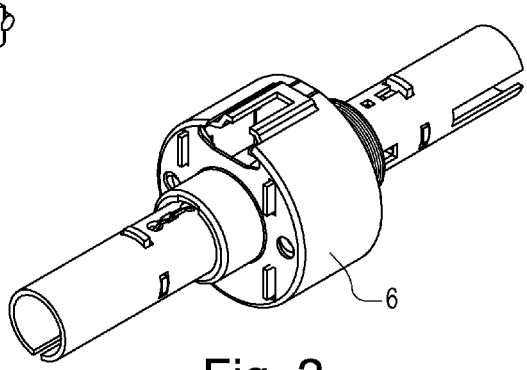
Fig. 2 PRIOR ART
FIG. 2 is a perspective view of the lockset of FIG. 1 with trim removed, revealing a lock body that contains only the retractor but not the return springs.
Figure 9:
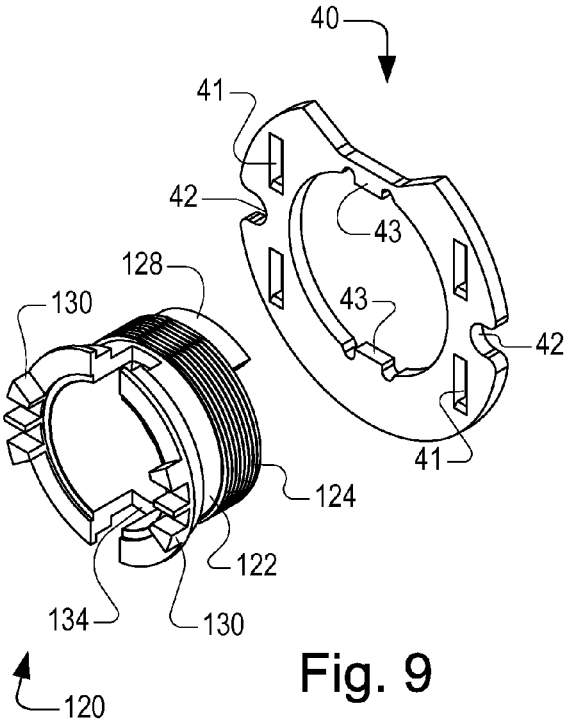
FIG. 9 is a perspective view of a pre-joined end plate and spindle bearing.
Figure 10:
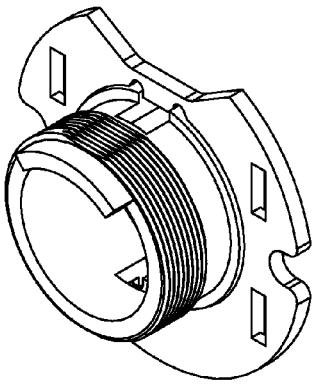
FIG. 10 illustrates one perspective view of the pre-joined end plate and spindle bearing following their interconnection.
Figure 11:
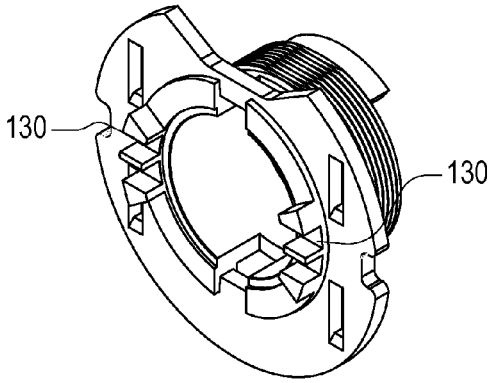
FIG. 11 illustrates an opposite perspective view of the pre-joined end plate and spindle bearing.
Figure 12:
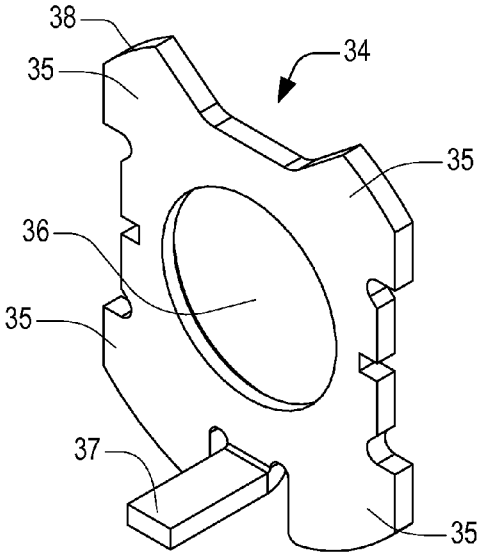
FIG. 12 is a perspective view of a separator plate.
Figure 18:
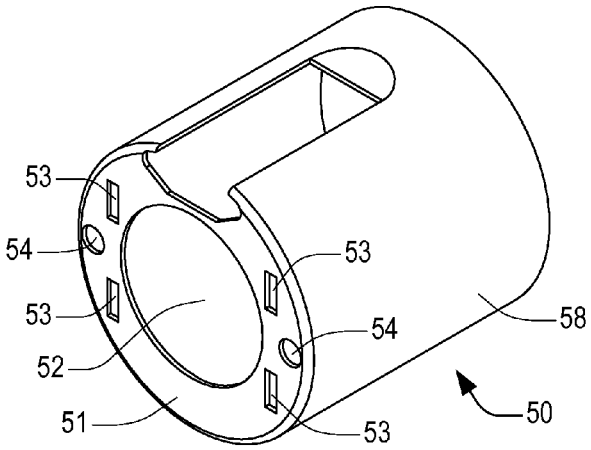
FIG. 18 is a perspective view of the cover.

The drawn sheet metal cover 50 (alternatively referred to as a cover cylinder), best illustrated in FIG. 18, comprises a ring-shaped base portion 51 and a cylindrical sleeve portion 58. The sleeve portion 58 has an outer radius sized for insertion and fit into a cylindrical aperture of a door. Unlike conventional sheet metal covers (such as the cover 6 illustrated in prior art FIG. 2), cover 50 encloses the spindle return springs 15, and is longer than most conventional sheet metal covers. The base portion 51 provides a spindle bearing aperture 52 and cage retaining slots 53. The cage retaining slots 53 are aligned with slots 41 of the end plate 40 (FIG. 9).

Figure 17:
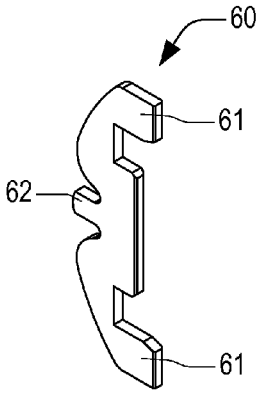
FIG. 17 is a perspective view of one of the keepers.

Sheet metal keepers 60, illustrated in FIGS. 17 and 24, secure the end plate 40 and cover 50 onto the lock cage lugs 28. The mounting legs 61 mount behind lug notches 29 of the lock cage main piece 21. Tabs 62 are bent into the tab holes 54 of the cover 50 and engage in cover retainer notches 42 of the end plate 40. As will be appreciated, the keepers 60 retain the end plate 40, as well as the cover 50, on the main piece 21, after the end plate 40 is directly axially inserted on to the main piece 21.

Several unique structures (which can be used individually or in combination) are provided to protect internal components of the lock body 19 from excessive torque and to transfer torque from the lock body 19, and in particular the multi-compartment lock cage subassembly 20, to the trim posts 232, to the door. One of these structures is a torque plate 110. Another structure is a lever-side rotational stop 128 on the spindle bearing 120. Yet another structure is a torque-attack-activated blocker assembly.

Referring first to the torque plate mechanism, torque plate index slots 24 are formed in the base portion 22 to receive tabs or flanges 112 of a torque plate 110. The torque plate 110 (FIG. 16) is—like the lock cage subassembly 20 itself—formed of sheet metal.

Figure 28:
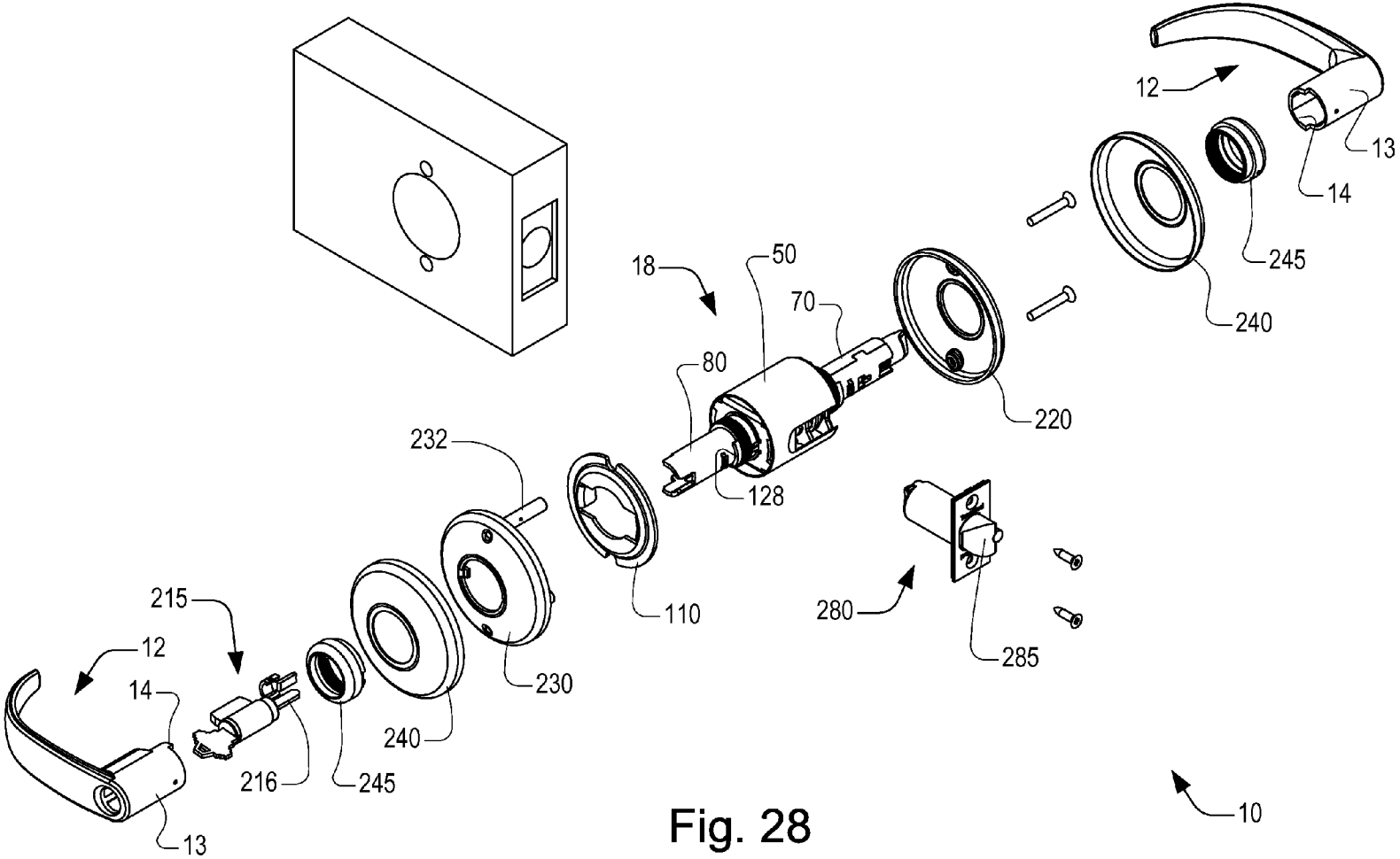
FIG. 28 is an exploded view of one embodiment of a cylindrical lock assembly or lockset, including a torque plate and trim pieces.
Figure 29:
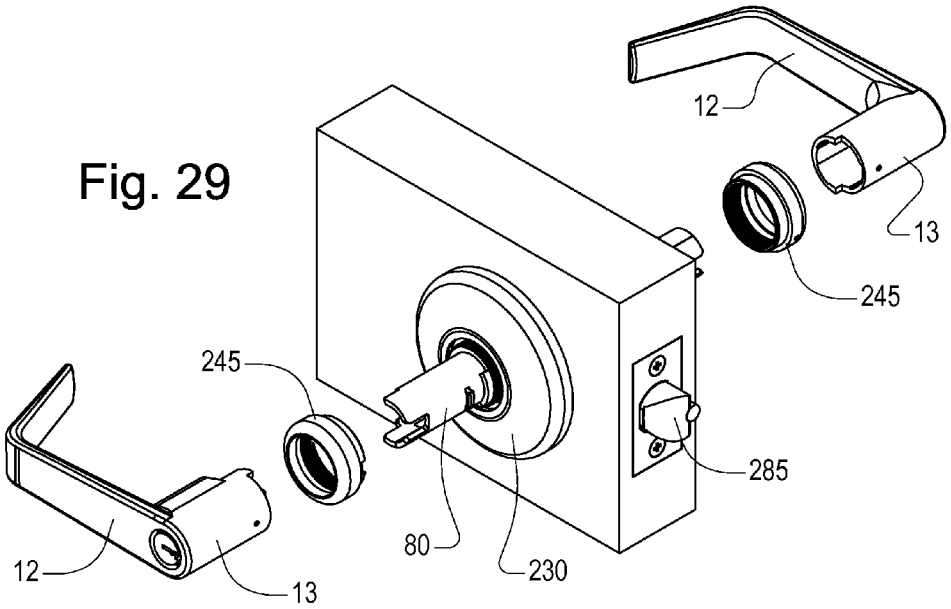
FIG. 29 is another partially exploded view of the cylindrical lock assembly or lockset partially installed in a door.
Figure 30:
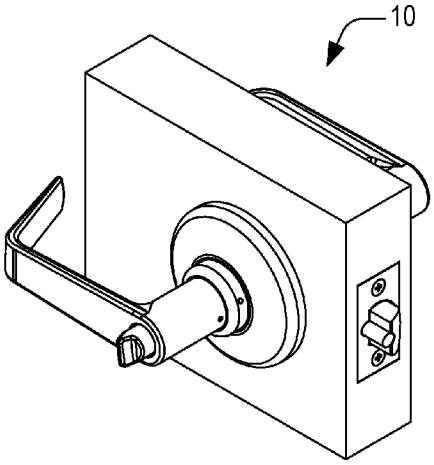
FIG. 30 is a perspective view of the assembled cylindrical lock assembly or lockset, including trim, and installed in a door.
Figure 31:
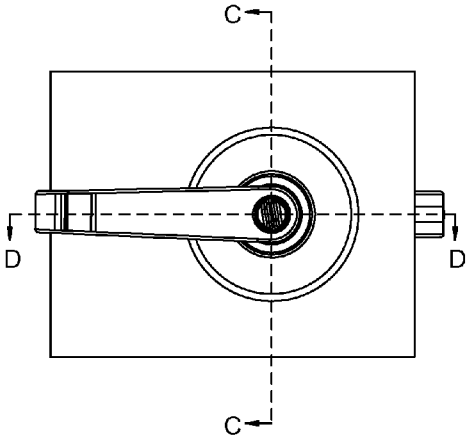
FIG. 31 is a front plan view of the assembled cylindrical lock assembly or lockset of FIG. 30.
Figure 32:
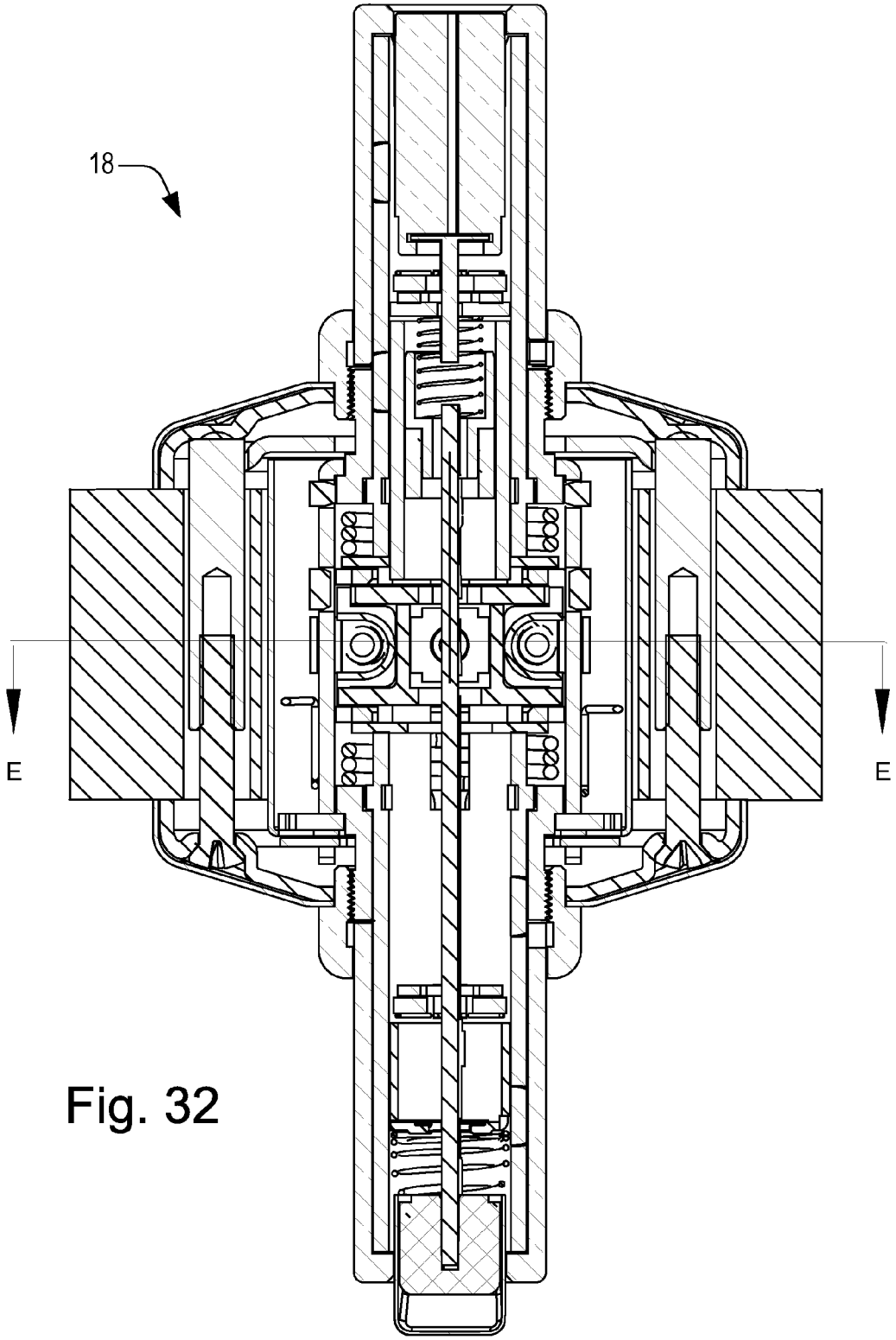
FIG. 32 is a partial cross-sectional view taken along line C-C of FIG. 31.
Figure 33:
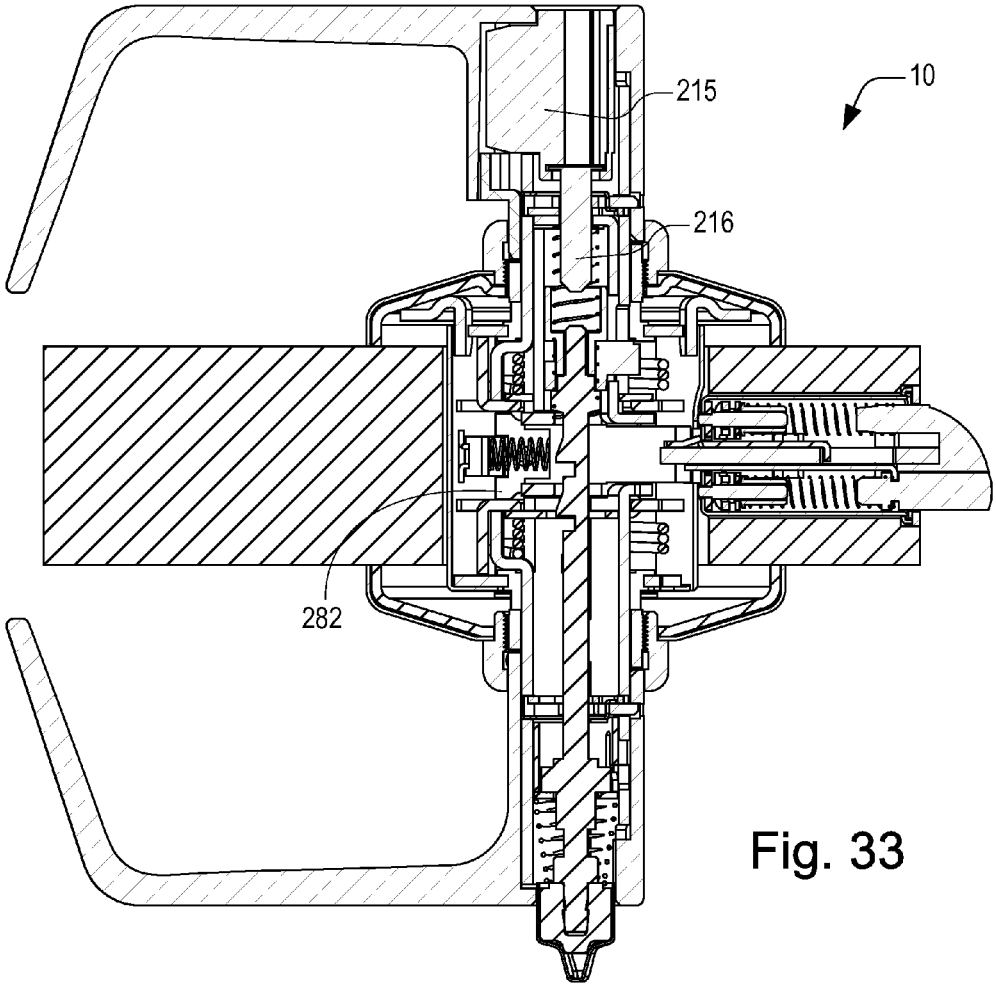
FIG. 33 is a partial cross-sectional view taken along line D-D of FIG. 31.
Figure 34:
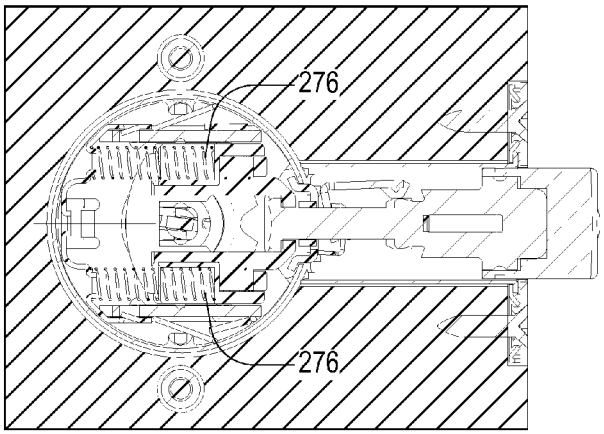
FIG. 34 is a partial cross-sectional view taken along line E-E of FIG. 32.
Figure 35:
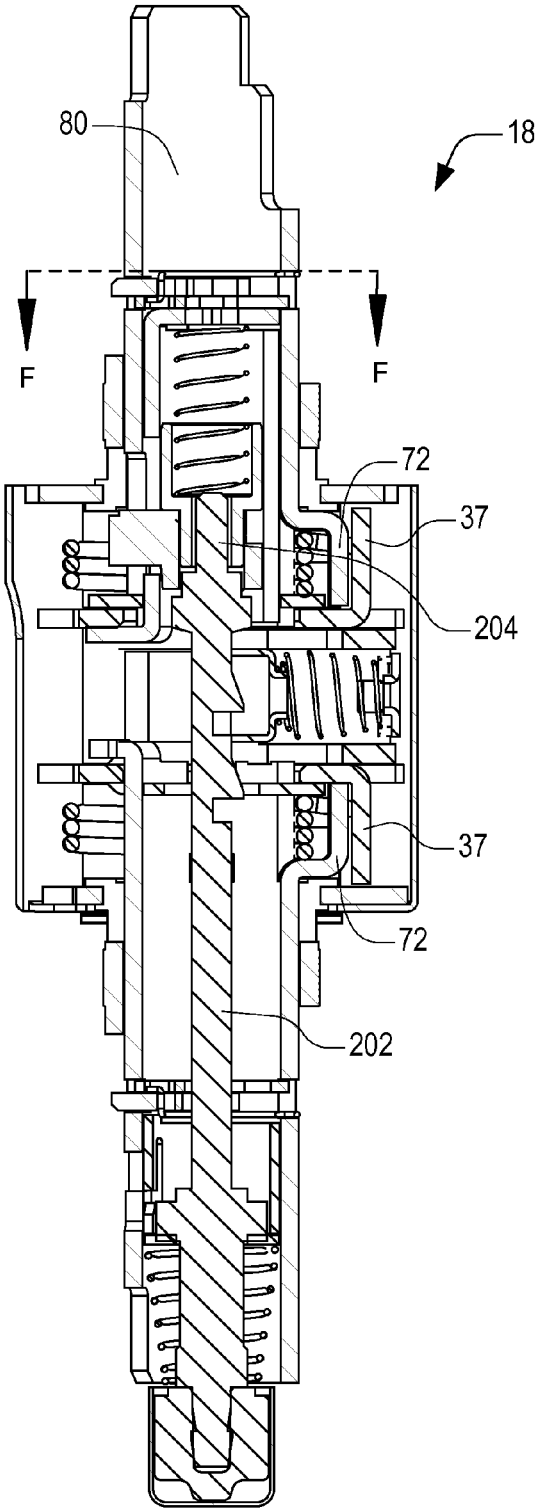
FIG. 35 is another partial cross-sectional view taken along line D-D of FIG. 31, not including any trim.

As illustrated in FIG. 26, the tabs (or flanges) 112 of the torque plate 110 index into the corresponding torque plate index slots 24 (FIG. 6) of the lock cage subassembly 20. The tabs 112 have an axial extent sufficient to support the use of the same cylindrical lock assembly 10 in a range of door widths (e.g., 1¾" to 2"). Radially distal notches (or cutouts) 114 formed in the torque plate 110 are configured to interface with, and transfer torque from the torque plate 110 to, the trim posts 232 (FIG. 28). A spindle bearing aperture 116 enables the torque plate 110 to be inserted over the spindle bearing 120.

The torque plate 110 is configured to be mounted between the lock cage subassembly 20 and a door trim rose 240. In the embodiment shown in FIG. 28, the torque plate 110 is a distinct piece from the outer rose insert 230. In another embodiment (not shown), the torque plate 110 is integrally formed with an outer rose insert 230.

It will be appreciated that this torque plate mechanism provides a path for load to be transferred from the lock case subassembly 20 to the torque plate 110 to the relatively radially distal trim posts 232 to the door itself.

Turning to the spindle bearing torque-transfer structures, an arcuate handle-side rotational stop 128 formed in the cylindrical sleeve 122 of the spindle bearing 120 (FIGS. 6, 9), just beyond its external threads, prevents over-rotation of a compatibly-configured handle 12 (e.g., FIG. 28) carried on the spindle 70 or 80 borne by the bearing 120.

It will be appreciated that in embodiments that combine a stop 128 with a torque plate 110, excessive torque exerted on the outer spindle 70 is transferred to the spindle bearing 120, from the spindle bearing 120 to the lock cage subassembly 20, from the lock cage subassembly 20 to the torque plate 110, from the torque plate 110 to the trim posts 232, and from the trim posts 232 to the door.

The potential still exists that an attacker would use a long pipe wrench or other device in an attempt to over-torque the lock in order break in. An example of overtorquing attack would be one in which sufficient force is exerted to rotate not just the handle 12, but also the spindle bearing 120, warping and potentially even breaking the stakes 33 (FIG. 6) of the lock cage main piece 21 that index into the spindle bearing notches 134. The attacker's goal with such an attack would be to force the outer cylinder 80 to rotate past its normal limits, and consequently force the key spindle assembly 140 to rotate to operate the latch.

With reference especially to FIGS. 6-8, 15, and 19-23, attention is now turned to an embodiment of a torque-attack-activated blocker assembly 264 coupled with a split retractor assembly 250 that thwarts such an attack. Looking first at FIG. 15, the retractor assembly 250 is—unlike conventional retractors—split into two components: an inner cam-activated retractor 251 and an outer cam-activated retractor 260. Under normal circumstances (where there has been no overtorquing attack), the retractor assembly 250 functions like a conventional retractor. The retractor assembly 250 is housed in the lock cage assembly 20. It is constrained for translational movement along or parallel to a longitudinal axis defined by extended and retracted positions of the latch 285. Cam engaging surfaces on either side of the refractor assembly 250 convert rotary motion from corresponding door handles into linear latch-retracting motion. Jaws 253 are provided to engage the tailpiece 282 (FIG. 33) of the latch bolt assembly 280, enabling the inside and outside door handles 13 to retract the latch 285. A longitudinal slot 254 gives the tailpiece 282 freedom to move inward relative to the retractor assembly 250, as might occur, for example, if the door is shut without retracting the latch.

In one configuration, the inside door handle is always operable to retract the latch, even during or after an outside overtorquing attack. The inside door handle is coupled to an inner spindle 70 that has retractor activation cams 71 (FIG. 46). Rotation of the inner spindle 70 in either direction causes a corresponding activation cam 71 to press down on the cam surfaces 256 of the inner cam-activated retractor 251, depressing it in the process.

In a similar but less direct fashion, the outside door handle, when unlocked, causes the key spindle assembly 140 to rotate. The retractor activation cams 146 on the key spindle assembly 140 are configured similarly to the retractor activation cams 71 on the inner spindle 70. Rotation of the key spindle assembly 140 in either direction causes a corresponding activation cam 146 to press down on the cam surfaces 263 of the outer cam-activated retractor 260, depressing it in the process.

The outer cam-activated retractor 260 is formed with shoulders 261 to enable another mechanism—such as the torque-attack-activated blocker assembly 264 discussed next—to block the outer cam-activated retractor 260 from traveling into a latch-retracting position. Under normal circumstances, where there hasn't been an overtorquing attack that has triggered a blocking action, depression of the outer cam-activated retractor 260 causes its thrust fingers 262 to press down on corresponding thrust shoulders 255 of the inner cam-activated retractor 251, depressing it and retracting the latch 285 in the process.

The blocker assembly 264 comprises at least one (and preferably two) spring-loaded blockers 265. Each blocker 265 comprises a trigger tab 266 and a stopping tab 267 configured to index into corresponding trigger and blocking slots 301 and 302 (FIG. 7), respectively, in the lock cage subassembly 20. As illustrated in FIGS. 25 and 27, the blocker assembly 264 is coupled to the lock cage subassembly 20, with one blocker 265 positioned on the outside of one of the edge flanges 25, and the other blocker 265 positioned on the outside of the opposite edge flange 25. Each blocker 265 is biased toward a blocking position by a biasing spring 268, such as a wire spring. One finger of the biasing spring 268 seats into the blocker. The opposite finger of the biasing spring 268 seats into the lock cage subassembly 20. A middle portion of the biasing spring 268 projects outward (FIGS. 20-21) to press against the interior surface of the cover 50.

Figure 22:
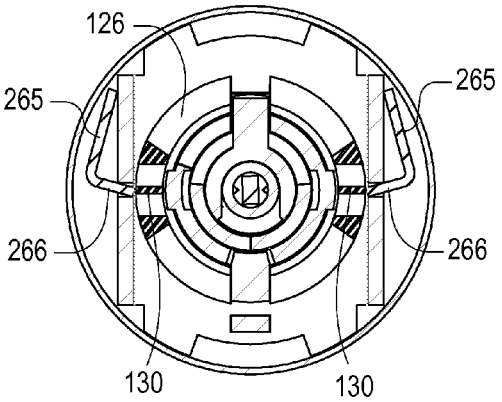
FIGS. 22 and 23 show the trigger tabs of the blocker assembly under normal and overtorque-attack-activated conditions, respectively, using partial cross-sectional views taken along line B-B of FIG. 19.
Figure 23:
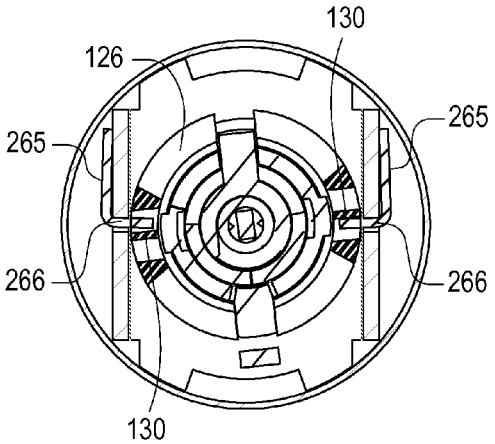

The blocker assembly 264 has a default non-blocking setting (FIGS. 20, 22) and an attack-triggered blocking setting (FIGS. 21, 23). FIGS. 20 and 22 illustrate the relative positions of the stopping tabs 267 in these two settings. FIGS. 21 and 23 illustrate the relative positions of the trigger tabs 266 in these two settings.

FIG. 21 illustrates how the stopping tabs 267, when in the blocking position, prevent the outer cam-activated retractor 260 from being depressed. Rotation of the key spindle assembly 140 still causes the refractor activation cams 146 to rotate and press against the outer cam-activated retractor 251. But the stopping tabs 267 interfere with the stop elbows 261 (FIG. 15) of the outer cam-activated retractor 260, disabling the outer cam-activated retractor and blocking it from moving into a latch-retracting position. In one embodiment, the stopping tabs 267 and outer cam-activated refractor 260 is made robust enough, relative to the retractor activation cams 146, that if enough overtorquing force is applied, the retractor activation cams 146 will deform or shear before the stopping tabs 260 would fail.

Figure 6:
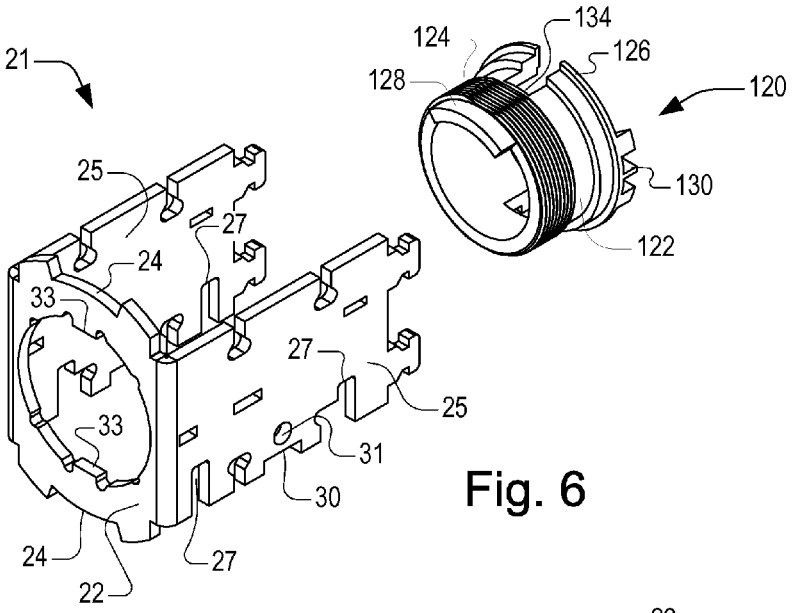
FIG. 6 is a perspective exploded view of the pre joined multi-compartmented lock cage subassembly main piece and spindle bearing.
Figure 7:
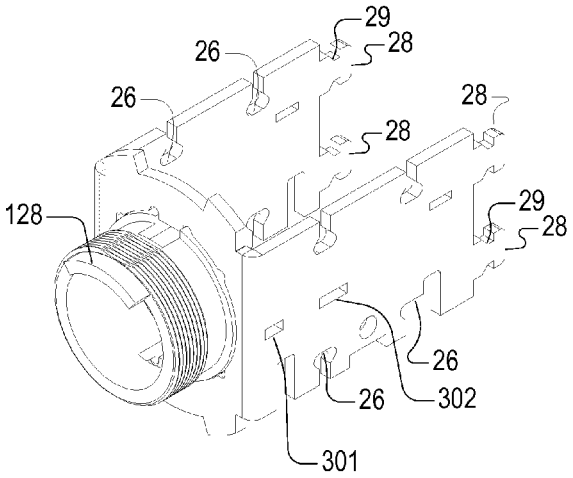
FIG. 7 is a perspective view of the spindle bearing following its assembly to the main piece.

When installed, the blocker assembly 264 is kept in a default non-blocking setting by holders or holder assembly 130—exemplified in FIG. 6 as posts the project from the cage retaining flange 126 of the spindle bearing 120—that hold the trigger tabs 266 out. (In other embodiments, not shown, the holder assembly 130 could be part of a separate piece that is not integral with the spindle bearing 120.) FIG. 22 illustrates how the holder assembly 130 keeps the tabs 266 and the blocker 265 in a non-blocking position. When an overtorquing attack causes the spindle bearing 120 to rotate relative to the lock cage subassembly 20, the holder assembly 130 rotates out of the way. FIG. 23 illustrates how the holder assembly 130, once rotated, no longer holds the tabs 266 and the blocker 265 in the non-blocking position In the foregoing manner, the blocker assembly 264 is operative to be activated by an overtorquing attack into a blocking setting. A spindle bearing 120 staked to the lock cage assembly 20 holds the blocker assembly 264 in the non-blocking setting as long as the outside door handle is not subjected to an overtorquing attack. But the spindle bearing 120 is configured to rotate, relative to the lock cage assembly 20, when the outside door handle is subjected to an overtorquing attack. Once rotated, the holder assembly 130 no longer holds the blocker assembly 264 in the non-blocking setting. Thus activated, the blocker assembly 264 snaps like a spring-loaded trap into a blocking position.

In the blocking setting, the blocker assembly 264 blocks movement of at least an outside door portion of a retractor assembly from translating into a latch-retracting position. It will be appreciated that, because of the split nature of the retractor assembly 250, the blocker assembly 264, when in the blocking setting, does not block the inside door handle from retracting the latch. In another embodiment, the retractor assembly 250 would not be split, but then an overtorquing attack would also disable the inside door handle from retracting the latch.

Attention is now focused on examples of key spindle assemblies 140 suitable for use with the cylindrical lock assembly 10. The cylindrical lock assembly 10 accommodates a vast number of key spindle assemblies (including both human-operated mechanical and electrically motor-actuated key spindle assemblies) configured to support different lock functions.

Figure 36:
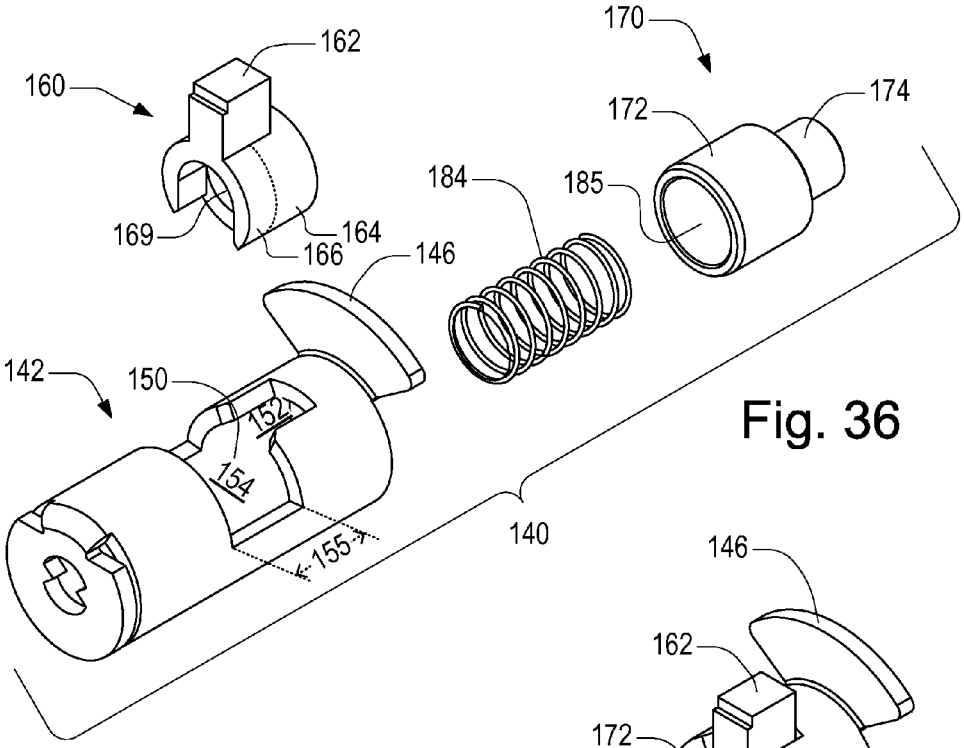
FIG. 36 is an exploded perspective view of one embodiment of a key spindle assembly.
Figure 37:
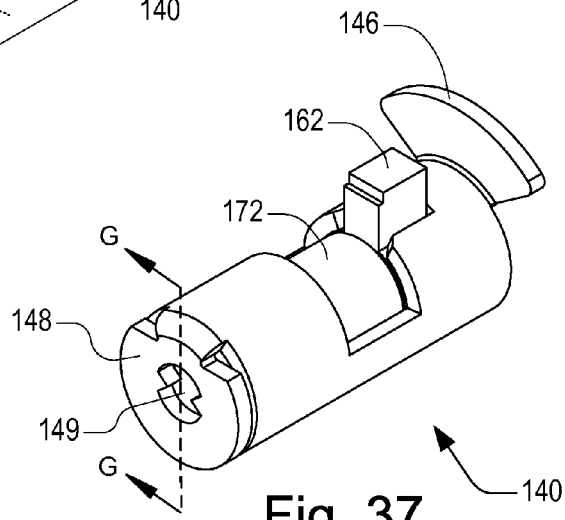
FIG. 37 is a perspective view of an assembled key spindle assembly.
Figure 39:
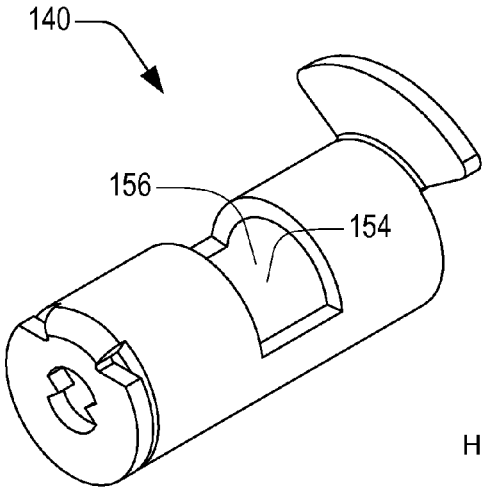
FIG. 39 is a perspective view of another embodiment of a key spindle, configured for a rigid trim lock function.
Figure 40:
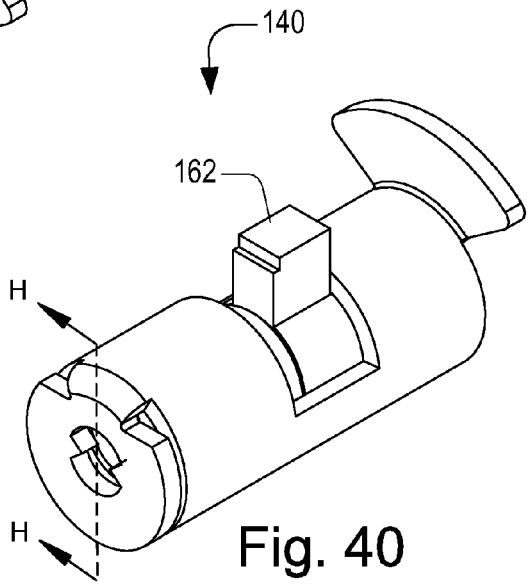
FIG. 40 is a perspective view of an assembled key spindle assembly configured for a rigid trim lock function.
Figure 41:
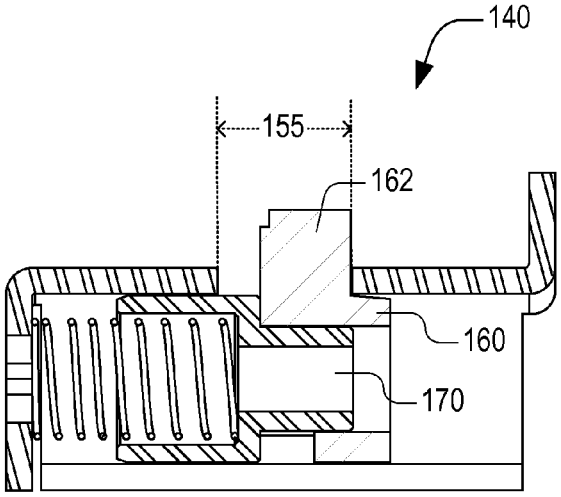
FIG. 41 is a partial cross-sectional view of the assembled key spindle assembly taken along line H-H of FIG. 40.

Illustrating just two of many contemplated human-operated mechanical embodiments, FIGS. 36 and 39 depict tubular key spindle assemblies 140 comprising a rolled up stamped sheet metal tubular key spindle 142 with folded-up retractor activation cams 146 and a folded down key plate 148. In like manner to the retractor activation cams 71 of the inner spindle 70, retractor activation cams 146 are configured to engage and operate on corresponding retractor slide cam surfaces 251 when a user turns an operatively coupled outside door handle 12.

The key spindle 142 houses a key spindle dog 160, a tubular dog guide 170, and a key spindle compression spring 184. The key spindle 142 is also provided with a dog travel window (or opening) 150 or 156 to enable rotational and/or axial movement of a dog arm 162.

Figure 3:
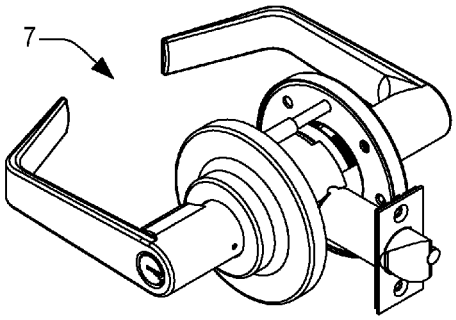
Fig. 3 PRIOR ART
FIG. 3 is a perspective view of another conventional prior-art cylindrical lockset, in which large cast spindle bearings are provided to house the lever return springs.

The dog travel window 150 or 156 is positioned opposite an axially extending seam 144 of the tubular key spindle 142, on the same side of the key spindle 142 as the retractor activation cams 146. In conventional key spindle assemblies, by contrast, a dog travel opening is positioned on the same side of the key spindle as the seam (and opposite any retractor activation cams). For example, FIG. 3 of U.S. Pat. No. 6,189,351 to Eagan illustrates a dog cam opening that is aligned with the key spindle seam, and opposite the key spindle's retractor activation cams. Accordingly, overtorquing (as in a warped door condition) can urge the seam apart. Moreover, in conventional designs, the dog travel opening (including, for example, Eagan's T-shaped slot 70) is open ended. Consequently, radially-oriented pins (e.g., Eagan's pin 60) are conventionally required to retain the locking dog in the key spindle. In the embodiments of FIGS. 36-41, by contrast, the dog travel window 150 or 156 is entirely closed (i.e., completely surrounded by a closed and continuous, non-welded, window edge of the key spindle 142). This further strengthens the key spindle 142 from overtorquing and facilitates use of a pinless key spindle dog 160.

The dog travel windows 150 and 156 of FIGS. 36 and 39 accommodate standard (rotatable) and rigid (or permanently inoperative) handle or lock functions, respectively. In the embodiment of FIG. 36, the dog travel window 150 is T-shaped, having an axial slot 152 enabling the dog 160 to translate axially, against the biasing force of compression spring 184, and a semicylindrical cross slot 154 enabling the dog 160 to rotate around the axis of the key spindle 142.

When the dog arm 162 is in the axial slot 152, the outer spindle 80 is "keyed" to the key spindle assembly 140, so that they will synchronously rotate. Stated another way, when the dog arm 162 is axially extended into the axial slot 152, the outside door handle 12 is operatively coupled to the latch 285. Torque from the outer spindle 80 is transmitted, through the interface between the key spindle dog driving slot 81 and the dog arm 162, to the key spindle dog 160. The key spindle dog 160 further transmits that torque, through the interface between its dog arm 162 and the axial slot 152, to the key spindle 142, and from there to the retractor activation cams 146.

In locking locksets, the "locked" position is defined by an axially retracted dog arm 162 butting up against the sides of the notches 134 of the outside spindle bearing 120, preventing rotation of the outer handle spindle 80. In clutching locksets, the unclutched position is defined by an axially retracted dog arm 162 free to rotate in the cross slot 154. When unclutched, torque from the key spindle dog driving slot 81 continues to be transmitted to the dog arm 162 and to the key spindle dog 160, but only to cause the dog 160 to rotate within the axial slot 152. Because the axial slot 152 has a significant, preferably approximately semicircular, angular extent, rotation of the outside spindle 80 is limited, by other means (e.g., rotational stop(s) 128 and/or 130), before the dog arm 160 ever reaches the axial edges of the cross slot 154. Accordingly, in an unclutched position, substantially no torque is transmitted from the outside spindle 80 to the key spindle 142, and therefore torque exerted on the outside spindle 80 is disabled from operating the split retractor 250.

Incidentally, the radial height of the dog arm 162 determines whether it provides a clutching or locking function. A taller dog arm 162 configures the key cylinder assembly 10 for locking configuration, because in the locking position the dog arm 162 butts up against the sides of the notches 134 of the outside spindle bearing 120, preventing rotation of the outer handle spindle 80. A smaller-height dog arm 162, by contrast, configures the key cylinder assembly 10 for a clutching configuration, because the inside diameter of the spindle bearing 120 clears the top of the dog arm 162. The only modification needed to reconfigure the key cylinder assembly 10 between locking and clutching configurations is to replace the key spindle dog 160 with one having an appropriately dimensioned dog arm 162.

In the embodiment of FIG. 39, contrasting with FIG. 36's embodiment, the dog travel window 156 provides only a substantially semicylindrical and branchless (e.g., no axial slot) dog travel opening for movement of the key spindle dog arm 162. Accordingly—whether through interference between the dog arm 162 and the spindle bearing notch 134 (i.e., a rigid trim lock configuration), or through free but inoperative rotational movement between otherwise provided rotational stops (i.e., a permanently unclutched trim lock configuration)—the outside spindle 80 (but not any key cylinder 215 held within) is permanently disabled from rotating the key spindle 142. A comparison of FIGS. 36 and 39 illustrates how selection between a standard lock trim configuration and a rigid lock trim configuration can be effected merely by selecting the appropriate key spindle assembly, and more particularly between key spindle assemblies that are substantially identically configured with the exception of the configuration of the dog travel opening 150 or 156, without structural modification of other parts of the cylindrical lock assembly 10.

In both FIGS. 36 and 39, keyed operation of the key cylinder 215 will—independently of any torque exerted on the outside door spindle 80—operate the key spindle 142 to retract the latch 285. This is because the keying operation transmits torque from the tailpiece or throw member 216 of the key cylinder 215 (FIG. 33), via its interface with the butterfly-shaped throw-member receiving aperture 216 of the key plate 148, to the key spindle 142 and its retractor activation cams 146.

The key spindle dog (or dog bushing) 160 is a metal part mounted for rotation about a tubular dog guide 170, the latter of which is biased away from the key plate 148 by key spindle compression spring 184. The key spindle dog 160 comprises a sleeve portion 164 that shares a cylindrical outer surface with a yoke portion 166, and a dog arm 162 protruding opposite and away from a U-shaped interior surface of the yoke portion 166. The aperture 169 of the sleeve portion 164 interfaces with the key spindle operator 204 of the stem 202 of the button subassembly 200 (FIG. 5).

The tubular dog guide (or plug bushing) 170 is a steel part comprising a spring seating and key spindle surface bearing cylindrical portion 172 and a cylindrical stub portion 174. The key spindle dog 160 rides and is operable to pivot on the cylindrical stub portion 174 of a tubular dog guide 170. The cylindrical portion 172 defines a tubularly interior spring seat 185 for the key spindle compression spring 184, which contrasts with the tubularly exterior spring seat of Eagan's tubular plug stem 68, for example.

Figure 38:
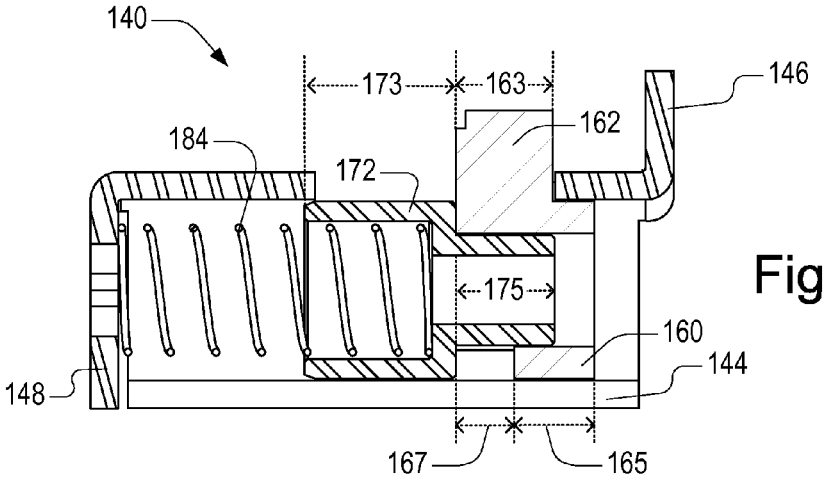
FIG. 38 is a partial cross-sectional view of the assembled key spindle assembly taken along line G-G of FIG. 37.

The axial length 155 (FIGS. 36, 41) of the cross slot 154 (FIG. 36) or dog window 156 (FIG. 39) is substantially greater than the axial length 163 (FIG. 38) of the dog arm 162, but just slightly greater than the combined axial lengths 165 and 167 (FIG. 38) of the sleeve and yoke portions 164 and 166 (FIG. 36), respectively. When the locking dog guide 170 is pushed (via a tool) substantially all of the way toward the key plate 148, the key spindle dog 160 can be inserted into (or removed from) the key spindle 142, through the cross slot 154, to ride on the cylindrical stub portion 174 of the tubular dog guide 170. Furthermore, as shown in FIG. 38, the axial length 173 of the primary cylindrical portion 172 of the tubular dog guide 170, plus the axial length 163 of the dog arm 162, is slightly greater than the axial length 155 of the semicylindrical cross slot 154 (FIG. 36), thereby preventing the tubular dog guide 170, when assembled with the key spindle dog 160, from cocking out of the cross slot 154. Also, as further shown in FIG. 38, the axial length 175 of the cylindrical stub portion 174 is in between the axial length 167 of the dog's yoke portion 166 and the combined axial lengths 165 and 167 of the dog's sleeve and yoke portions 164 and 166, so that the stub portion 174 extends part, but not all, of the way into the sleeve portion 164.

It is noted that the pivotable operation of the dog 160 facilitates escapement between the key cylinder 142, the dog 160, and the dog guide 170. With the biasing aid of the compression spring 184, key-operated rotation of the key spindle 142 relative to the outer handle-carrying spindle 80 causes the dog arm 162 to escape from the cross slot 154, if held therein, into the axial slot 152, when the axial slot 152 rotates into alignment with the key spindle dog driving slot 81 of the spindle 80.

It is noted that the structure of the cylindrical lock assembly 10 supports a much broader variety of key cylinder assemblies than the ones detailed, for exemplary and illustrative purposes, above. These include key cylinder assemblies with significantly structurally and functionally different key spindles, dogs and dog guides, as well as key cylinder assemblies with different and/or additional components. For example, assemblies providing different combinations of lock functions, assemblies involving either two inside spindles or two outside spindles, and electronic, motor-actuated configurations may suggest structurally different key cylinder assemblies.

Attention is now focused on a new and improved knob catch assembly 100, illustrated in FIGS. 43-51. It will be understood that "knob catch" is a conventional term of art, and that knob catches are suitable for retaining both conventional knobs and eccentric levers.

The knob catch assembly 100 (alternatively referred to as a knob keeper) comprises a knob catch 101, a knob catch spring 104, and a backup washer 107. The knob catch 101 (alternatively referred to as a catch body or driver) includes a projecting lug (or catch tongue) 102 that projects through a knob catch lug cross slot 76 of the handle-carrying spindle 70 or 80. The knob catch 101 also includes a spring leg aperture, in which the legs 106 of the knob catch spring 104 are seated, to urge the projecting lug 102 of the knob catch 101 into a handle-retaining position.

Figure 50:
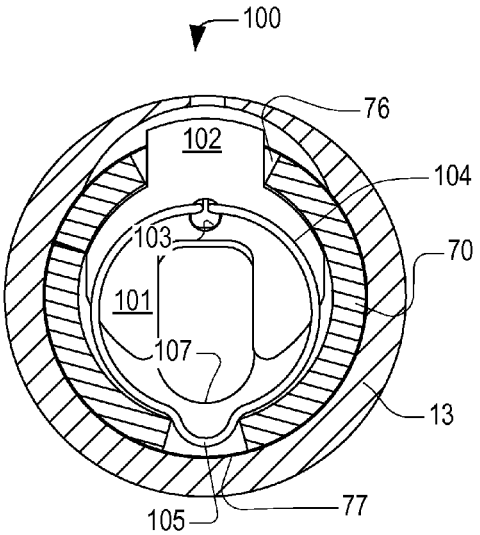
FIG. 50 is a partial cross-sectional view of an inside spindle and knob catch assembly showing the knob catch in a lever-restraining position.
Figure 51:
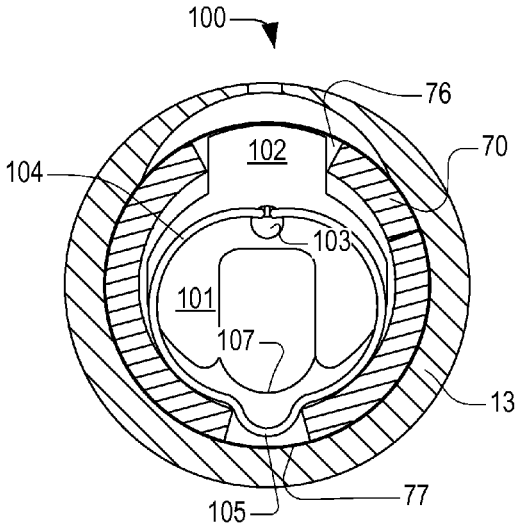
FIG. 51 is a partial cross-sectional view of the inside spindle and knob catch assembly showing the knob catch in a retracted position and the knob catch spring in an elastically deformed position.

The wrap around knob catch spring 104 is an arcuate-shaped wire formed into a substantially continuously curved segment extending approximately a full 360 degrees around a nearly circular arc (FIG. 50). In an alternative embodiment, the curved segment extends around a shorter arc, but one that is still greater than 180 degrees. When release-actuating force is imposed on the knob catch assembly 100, it causes elastic deformation (and bulging) of a substantial portion of the arcuate segment of the wrap-around catch spring 104 (as illustrated in FIG. 51). By contrast, the polygonally-shaped spring 150 illustrated in U.S. Pat. No. 4,394,821 to Best, release-actuating load is borne disproportionately in the bends between the transverse and side legs 250 and 252. Here, by contrast, release-actuating load is distributed more evenly, and along most of the arcuate portion, of the spring 104.

The radiused spring bump (or nub) 105 formed in the wrap around spring 104, opposite the catch spring legs 106, seats the spring 104 in the knob catch spring seat 77 of the handle-carrying spindle 70 or 80. The legs 106 of the knob catch spring 104 are held in the spring feet aperture 103 (or in an alternative embodiment, in a notch or in two separate apertures or notches), of the knob catch 101.

The knob catch backup washer 107 is inserted in bent form, and then straightened and pressed into face-to-face contact with the knob catch 101. When pressed into place, a first tab 108, next to knob catch lug 102, seats into a T-stem of the knob catch lug cross slot 76 (FIG. 24), and a second tab 109, next to the knob catch spring bump 105, seats into the knob catch spring seat 77, adjacent the knob catch spring 104.

Figure 42:
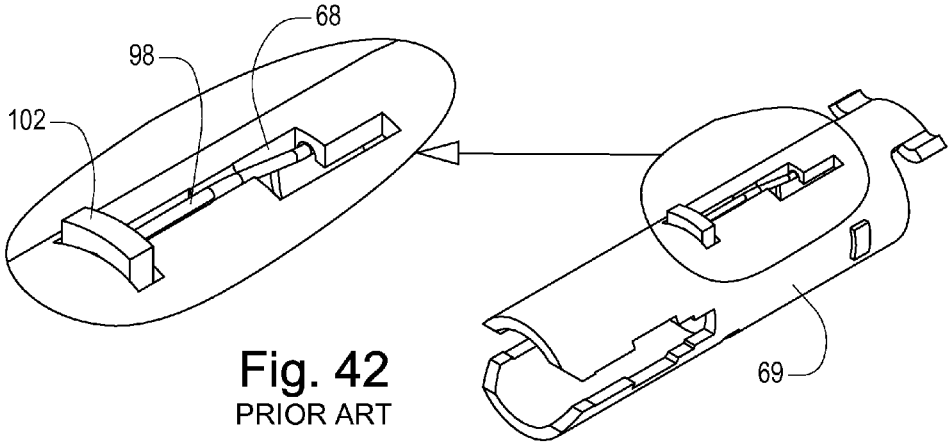
Fig. 42 PRIOR ART
FIG. 42 illustrates a conventional cantilever-type knob catch assembly housed in a spindle, the knob catch assembly including an elongated cantilevered spring held within an elongated axial slot of the spindle.
Figure 43:
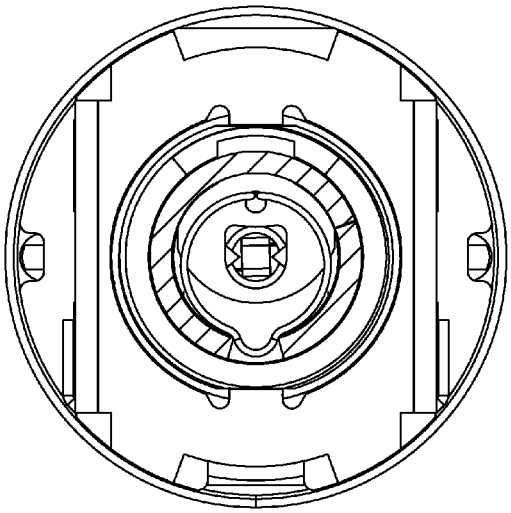
FIG. 43 is a partial cross-sectional view taken along line F-F of FIG. 35, illustrating one embodiment of an outside handle knob catch assembly.
Figure 44:
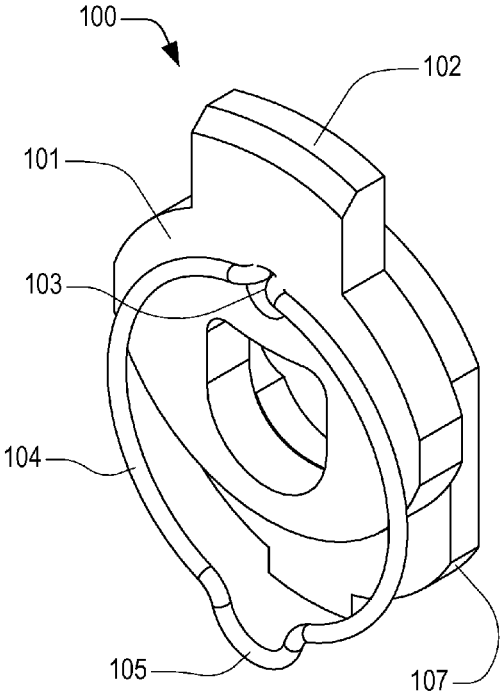
FIG. 44 is a perspective view of one embodiment of the outside handle knob catch assembly.
Figure 49:
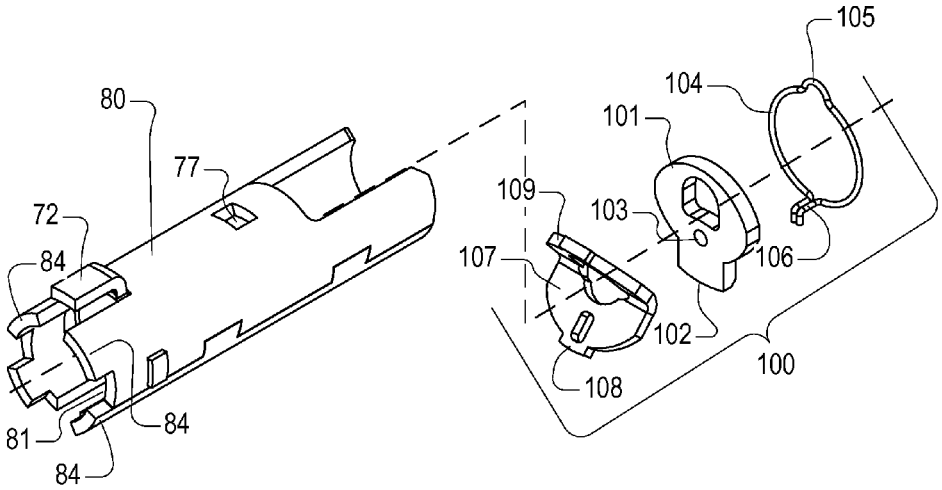
FIG. 49 is an exploded view of an embodiment of the outside handle knob catch assembly handle-carrying.

It will be appreciated that the knob catch assembly 100 improves significantly over cantilevered spring wire knob catch designs (such as illustrated in FIG. 42), which are either comparatively weak or easily and quickly overstressed. The knob catch assembly 100 also improves over the knob catch configuration of U.S. Pat. No. 4,394,821 to Best. As shown in FIGS. 8 and 9 of the latter patent, Best's polygonally-shaped spring 150 cams on the inside of the spindle. Moreover, Best's design calls for a much longer transverse slot 146, resulting in a weaker spindle, than the knob catch spring seat 77 provided in the spindles 70 and 80 shown herein. As is evident from the drawings, seat 77 has a much smaller profile than the cross slot provided for the knob catch assembly illustrated in Best.

Turning attention to a few remaining details, external threads 124 are provided on each spindle bearing 120 for receiving correspondingly internally threaded rose collars 245 (FIG. 28). Also, as illustrated best in FIG. 28, handle (e.g., lever or knob) 12 comprises a sleeve 13 with a stepped, axially extending portion 14 that butts against the handle-side rotational stop 128 of the spindle bearing 120 at configured limits of handle rotation.

Figure 4:
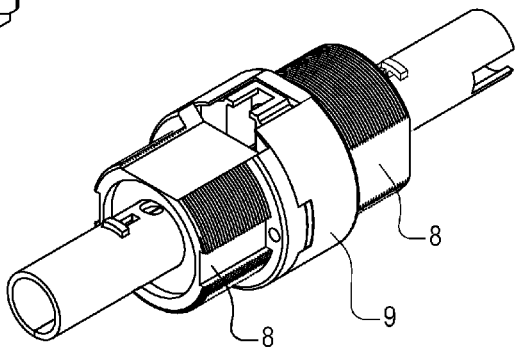
Fig. 4 PRIOR ART
FIG. 4 is a perspective view of the lockset of FIG. 3 with trim removed, revealing a lock cage and cover that contains only the retractor and large cast spindle bearings housing the lever return springs.

Notably, the spindle bearing 120 (FIG. 6) has a relatively small profile, unlike conventional enlarged spindle bearings (of which FIG. 4 is one illustration) that are designed to encase a spindle return spring. Likewise, the rose inserts 220 and 230 and roses 240 (FIG. 28), like the spindle bearing 120, have a relatively small profile, compared to conventional enlarged roses and/or rose inserts (of which FIG. 1 is an illustration) that are designed to encase a spindle return spring.

Among the many advantages various aspects that the innovations disclosed herein provide over the prior art, it will be appreciated that one of them is the enablement of the production of high strength cylindrical locksets at significantly lower production costs than prior art designs having comparable (and in some aspects inferior) strength and functionality. For example, fewer and/or smaller costly components are needed. The lock cage subassembly 20, torque plate 110, cover 50, keepers 60, spindles 70 and 80, key spindle 142, and rose inserts 220 and 230 (not including trim posts 232) can all, for example, be produced from stamped sheet metal. Other components (e.g., machined components)—such as the spindle bearings 120—are significantly smaller and lighter weight than functionally comparable cast part alternatives. No cast parts and no large and expensive spindle-return-spring cages are needed.

Furthermore, the innovations disclosed herein enable production of high strength cylindrical locksets that are potentially lighter, and with a rose trim set that is smaller and more discretely profiled, than prior art designs having comparable strength and functionality.

Yet another advantage is the support of a broad spectrum of lock functions while minimizing configuration differences and the number of differently configured components.

Yet further advantages include stronger handle-carrying spindles 70 and 80, a stronger key spindle 140, a cage assembly indexing torque plate 110, new and improved rotational stops 128 and 130, and knob catch assembly 100 improvements.

All of the aforementioned prior art references are herein incorporated by reference for all purposes.

It should be noted that the embodiments illustrated and described in detail herein are exemplary only, and that various other alternatives, adaptations, and modifications may be made within the scope of the present invention. Accordingly, the present invention is not limited to the specific embodiments illustrated herein, but is limited only by the following claims.

We claim:

1. A cylindrical lockset designed to thwart an overtorquing attack, the cylindrical lockset comprising:

a latch;

a lock cage configured to be mounted inside a cylindrical bore of a door that passes from an outside door face to an inside door face;

a retractor assembly housed in the lock cage and configured to enable inside and outside door handles to retract the latch;

a lock housed in the lock cage and operative, when activated, to prevent a person from using the outside door handle to open the door; and a torque-attack-activated blocker assembly coupled to the lock cage, the blocker assembly being coupled in a default non-blocking setting and operative to be activated by an overtorquing attack into a blocking setting;

wherein the blocker assembly, when in the blocking setting, blocks the outside door handle from causing the retractor assembly to retract the latch.

2. The cylindrical lockset designed to thwart an overtorquing attack of claim 1, wherein the blocker assembly, when in the blocking setting, does not block the inside door handle from retracting the latch.

3. The cylindrical lockset designed to thwart an overtorquing attack of claim 1, wherein the retractor assembly is constrained for translational movement along or parallel to a longitudinal axis defined by extended and retracted positions of the latch.

4. The cylindrical lockset designed to thwart an overtorquing attack of claim 3, wherein the blocker assembly, when in the blocking setting, blocks movement of at least an outside door portion of the retractor assembly from translating into a latch-retracting position.

5. The cylindrical lockset designed to thwart an overtorquing attack of claim 4, wherein the retractor assembly comprises an inner cam-activated retractor and an outer cam-activated retractor, the outer cam-activated retractor configured, when activated and not blocked by the blocker assembly, to press the inner cam-activated retractor to retract the latch.

6. The cylindrical lockset designed to thwart an overtorquing attack of claim 5, wherein:

the blocker assembly comprises a pair of stopping tabs, and the outer cam-activated retractor comprises a pair of stop elbows; and when the blocker assembly is in a blocking setting, the stopping tabs interfere with the stop elbows to block the outer cam-activated retractor from moving into a latch-retracting position.

7. The cylindrical lockset designed to thwart an overtorquing attack of claim 1, further comprising a spindle bearing staked to the lock cage, the spindle bearing coupled to the blocker assembly and maintaining it in the non-blocking setting as long as the outside door handle is not subjected to an overtorquing attack.

8. The cylindrical lockset designed to thwart an overtorquing attack of claim 7, wherein the spindle bearing is configured to rotate, relative to the lock cage, when the outside door handle is subjected to an overtorquing attack.

9. The cylindrical lockset designed to thwart an overtorquing attack of claim 1, further comprising a holder assembly positioned on an inside of the lock cage, the holder assembly holding the blocker assembly in the non-blocking setting as long as the outside door handle is not subjected to an overtorquing attack, wherein an overtorquing attack causes rotation of the holder assembly, causing the blocker assembly to move into the blocking setting.

10. The cylindrical lockset designed to thwart an overtorquing attack of claim 9, wherein the holder assembly comprises posts situated on a cage retaining flange of a spindle bearing staked to the lock cage, the posts holding corresponding trigger tabs of the blocker assembly in the non-blocking setting.

11. The cylindrical lockset designed to thwart an overtorquing attack of claim 1, wherein the blocker assembly is spring-loaded to spring from its non-blocking setting to its blocking setting when the outside door handle is subjected to an overtorquing attack.

12. The cylindrical lockset designed to thwart an overtorquing attack of claim 11, wherein the blocker assembly comprises a pair of blockers, each blocker comprising a trigger tab and a stopping tab, each blocker being spring loaded by a spring.

13. A cylindrical lockset designed to thwart an overtorquing attack, the cylindrical lockset comprising:

inner and outer spindles configured to receive inside and outside door handles;

a latch;

a lock cage configured to be mounted inside a cylindrical lock door bore that passes from an outside door face to an inside door face;

a retractor assembly housed in the lock cage and configured to enable the inside and outside door handles to retract the latch; and a trap coupled to the lock cage, the trap operable to be activated by an overtorquing attack to prevent the outer spindle from causing the retractor assembly to retract the latch.

14. The cylindrical lockset designed to thwart an overtorquing attack of claim 13, wherein the trap is spring-loaded.

15. The cylindrical lockset designed to thwart an overtorquing attack of claim 14, further comprising an outer spindle bearing mounted to the lock cage, wherein the spring-loaded trap is triggered by rotation of the outer spindle bearing relative to the lock cage.

16. The cylindrical lockset designed to thwart an overtorquing attack of claim 13, wherein the retractor assembly is constrained for translational movement along a longitudinal axis along which the latch retracts, the retractor assembly comprising an inner cam-activated retractor and an outer cam-activated retractor, the outer cam-activated retractor configured to press the inner cam-activated retractor to retract the latch.

17. The cylindrical lockset designed to thwart an overtorquing attack of claim 16, wherein the trap, when activated, disables the outer cam-activated retractor.

* * * * *